US010626594B2

(12) United States Patent
Yu et al.

(10) Patent No.: US 10,626,594 B2
(45) Date of Patent: Apr. 21, 2020

(54) FABRICATED STRUCTURAL SYSTEM AND ASSEMBLING METHOD THEREOF

(71) Applicant: New World China Land Limited, Hong Kong (HK)

(72) Inventors: De Ming Derry Yu, Hong Kong (HK); Wenjie Michael Lu, Hong Kong (HK); Kam Ching Ivan Kong, Hong Kong (HK)

(73) Assignee: NEW WORLD CHINA LAND LIMITED, Hong Kong (HK)

( * ) Notice: Subject to any disclaimer, the term of this patent is extended or adjusted under 35 U.S.C. 154(b) by 112 days.

(21) Appl. No.: 15/903,384

(22) Filed: Feb. 23, 2018

(65) Prior Publication Data

US 2018/0245329 A1 Aug. 30, 2018

(30) Foreign Application Priority Data

Feb. 24, 2017 (CN) ..... 2017 1 0104308
Sep. 8, 2017 (CN) ..... 2017 1 0804408

(51) Int. Cl.
*E04B 1/19* (2006.01)
*E04B 1/24* (2006.01)
(Continued)

(52) U.S. Cl.
CPC ..... *E04B 1/1903* (2013.01); *E04B 1/2403* (2013.01); *E04B 1/5812* (2013.01);
(Continued)

(58) Field of Classification Search
CPC .... E04B 1/1903; E04B 1/2403; E04B 1/5812; E04B 2001/2457; E04B 2001/2415;
(Continued)

(56) References Cited

U.S. PATENT DOCUMENTS 949,394 A * 2/1910 Daly ..... E04B 1/2403 403/173
3,315,995 A 4/1967 Hossli et al.
(Continued)

FOREIGN PATENT DOCUMENTS

CN 2252833 Y 4/1997
CN 1558981 A 12/2004
(Continued)

*Primary Examiner* — Brian E Glessner
*Assistant Examiner* — Adam G Barlow
(74) *Attorney, Agent, or Firm* — Hogan Lovells US LLP

(57) ABSTRACT

The present application provides a prefabricated structural system and an assembly method thereof. The prefabricated structural system may be applied to steel structures, reinforced concrete structures and timber structures. When applied to the steel structures, the prefabricated structural system includes a plurality of steel structure joints and related members. The steel structure joints and related members further comprise: a beam-column connecting sleeve, comprising a first box-shaped steel tube and first C-shaped sleeves extending from and perpendicular to outer surfaces of the first box-shaped steel tube, wherein the first C-shaped sleeve is provided with first wedge shaped recesses at ends of upper and lower flanges thereof; columns, having a column connecting end inserted into the first box-shaped steel tube; main beams, having a main beam connecting end inserted into the first C-shaped sleeve; and main beam fixing steel plates, provided with first wedge shaped protrusions that are tenon-mortise-jointed with first wedge shaped recesses at both sides of the first C-shaped sleeve. In addition to the steel structural construction, the beam-column connecting sleeve of the prefabricated structural system may be further extended to reinforced concrete structures and timber structures.

25 Claims, 17 Drawing Sheets

(51) Int. Cl.
*E04B 1/58* (2006.01)
*E04B 1/21* (2006.01)
*E04B 1/26* (2006.01)

(52) U.S. Cl.
CPC ..... *E04B 1/215* (2013.01); *E04B 1/2604* (2013.01); *E04B 2001/246* (2013.01); *E04B 2001/2409* (2013.01); *E04B 2001/2415* (2013.01); *E04B 2001/2427* (2013.01); *E04B 2001/2448* (2013.01); *E04B 2001/2457* (2013.01)

(58) Field of Classification Search
CPC ..... E04B 2001/246; E04B 1/1912; E04B 1/1918; E04B 1/1921; E04B 1/1909; Y10T 403/341; Y10T 403/342; Y10T 403/347; F16B 2200/30
USPC ..... 52/261, 282.2, 280, 648.1, 649.1, 649.2, 52/655.1, 665, 704, 838, 839; 403/170, 403/171, 176, 381; 248/300
See application file for complete search history.

(56) References Cited

U.S. PATENT DOCUMENTS 3,938,297 A * 2/1976 Sato ..... E04B 1/2403 403/188
4,558,968 A 12/1985 Meickl
5,238,321 A * 8/1993 Jarjoura ..... A47B 57/44 256/65.03
5,605,410 A * 2/1997 Pantev ..... F16B 7/0486 403/174
7,637,076 B2 * 12/2009 Vaughn ..... E02D 27/34 403/169
7,762,038 B2 * 7/2010 Ceba ..... E04B 1/2403 52/653.1
7,883,288 B2 * 2/2011 Jorna ..... F16B 7/0453 403/171
7,941,985 B2 * 5/2011 Simmons ..... E04B 1/24 52/655.1
9,458,619 B2 * 10/2016 Bowron ..... E04B 1/3483
9,765,805 B2 * 9/2017 Pond ..... F16B 17/00
10,179,991 B2 * 1/2019 Houghton ..... E04B 1/2403
10,253,492 B2 * 4/2019 Uno ..... E04B 1/215
2003/0041549 A1 3/2003 Simmons et al.
2007/0261356 A1 * 11/2007 Vaughn ..... E02D 27/34 52/655.1
2013/0232758 A1 9/2013 Pond
2014/0338280 A1 * 11/2014 Tanaka ..... E04B 1/2403 52/655.1
2016/0090729 A1 * 3/2016 Takahashi ..... E04B 1/2403 52/698
2018/0094419 A1 * 4/2018 Houghton ..... E04B 1/2403
2018/0245329 A1 * 8/2018 Yu ..... E04B 1/2403

FOREIGN PATENT DOCUMENTS

CN 203742000 U 7/2014
CN 203878781 U 10/2014
CN 205189172 U 4/2016
CN 106368315 A 2/2017
EP 0054802 A1 6/1982
HU 181392 B 7/1983
JP H03093504 9/1991
JP 0460037 A 2/1992
JP 04153425 A 5/1992
JP 2006328676 12/2006
WO 03/021061 A1 3/2003

* cited by examiner

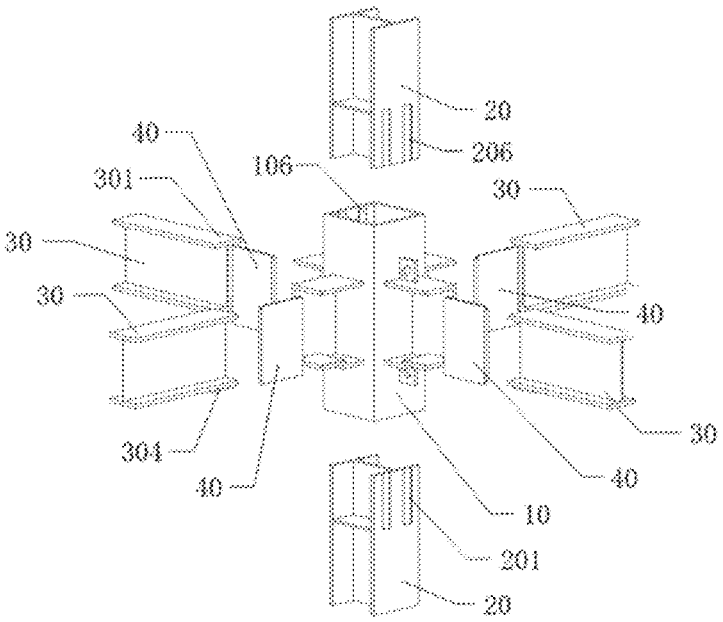
Fig. 3
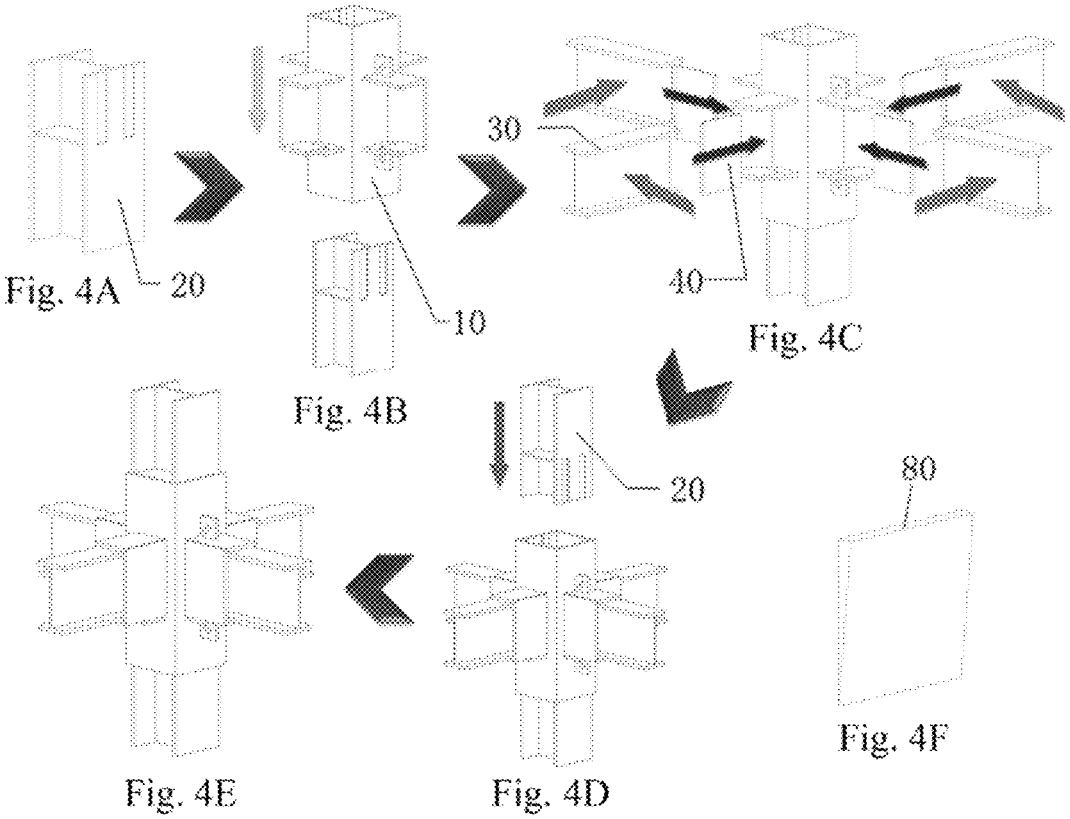

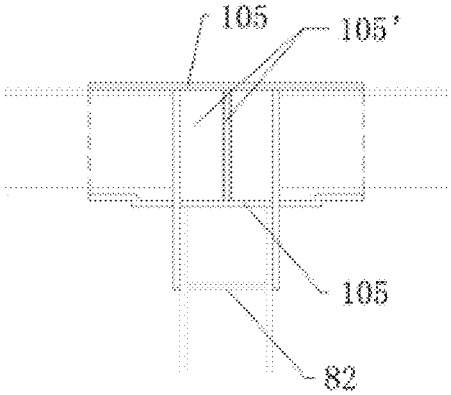
Fig. 7A
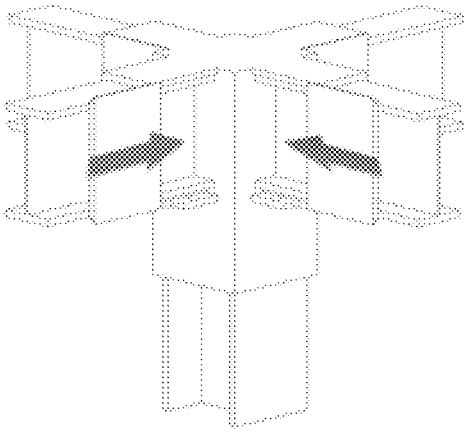
Fig. 7B
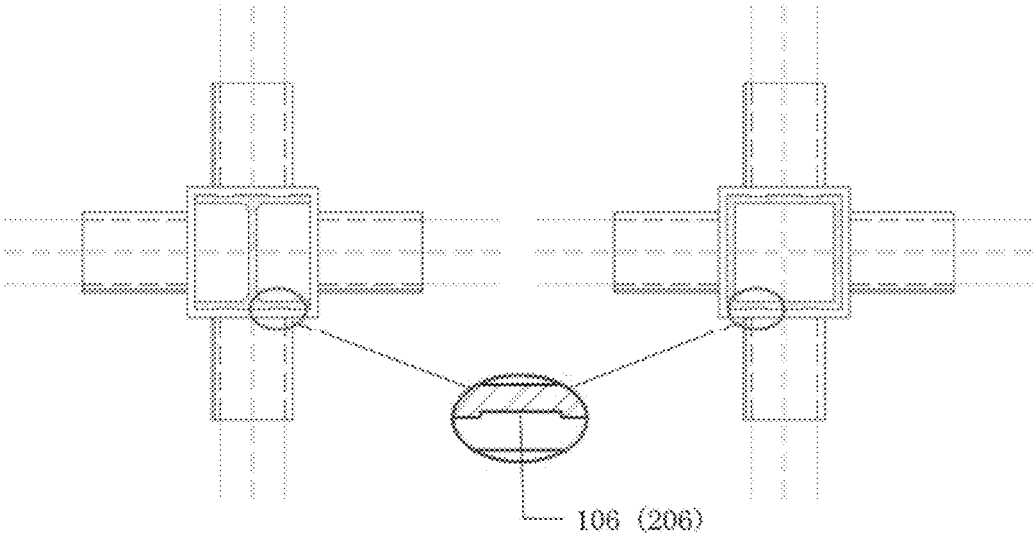
Fig. 8A
Fig. 8B

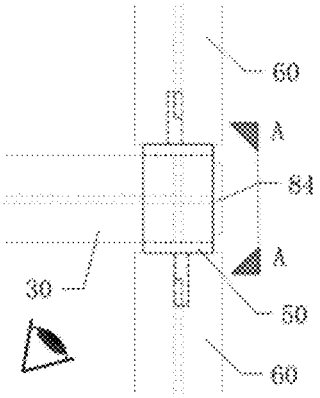
Fig. 17A
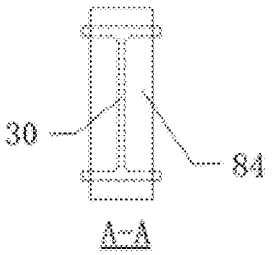
Fig. 17B
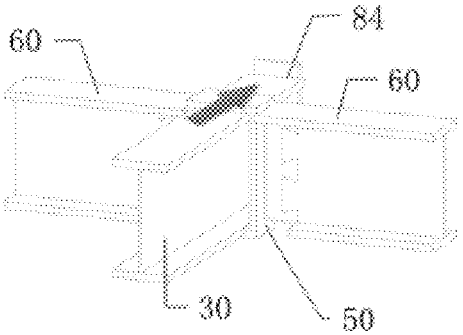
Fig. 17C
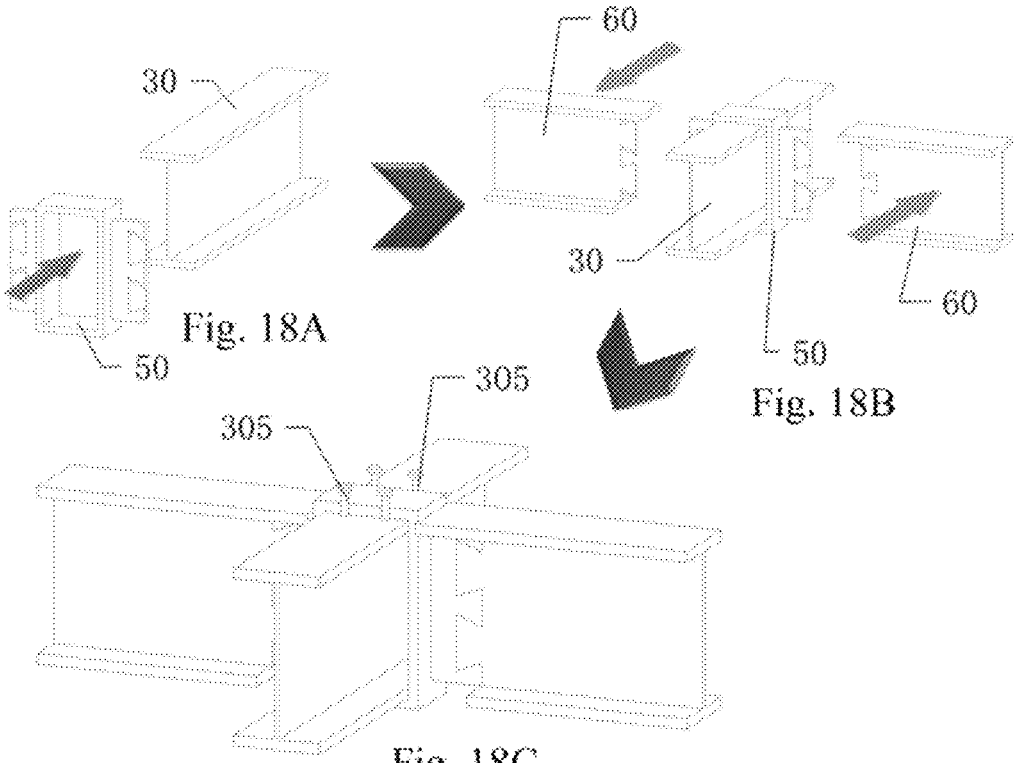
Fig. 18A
Fig. 18B
Fig. 18C

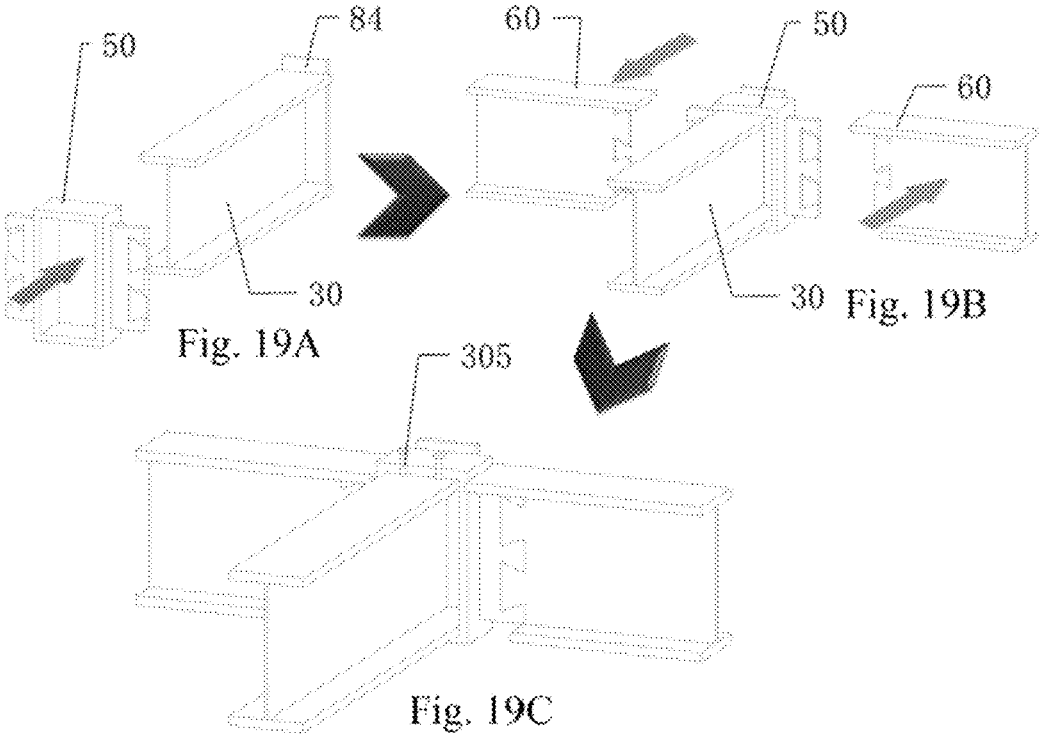
Fig. 19A
Fig. 19B
Fig. 19C
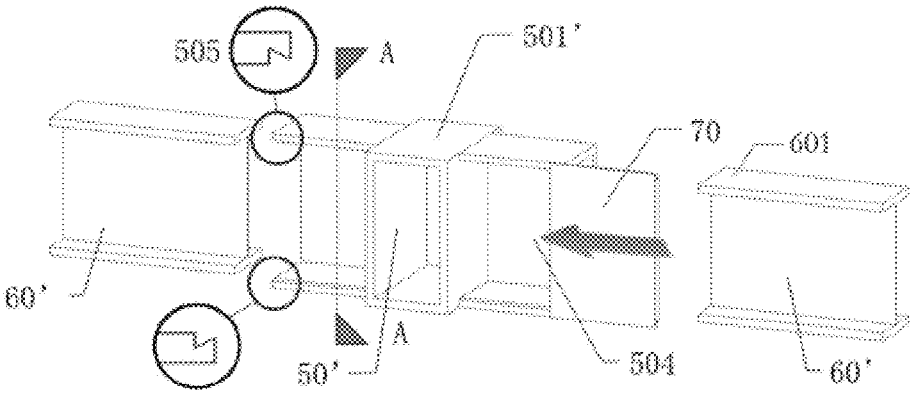
Fig. 20A
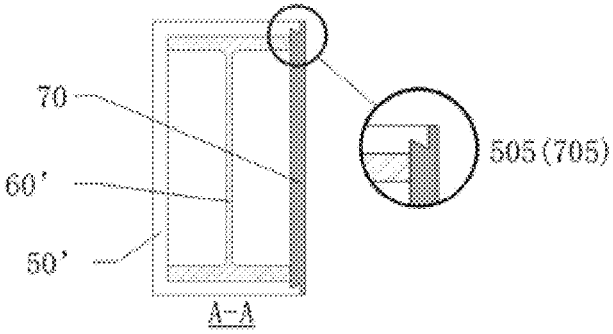
Fig. 20b

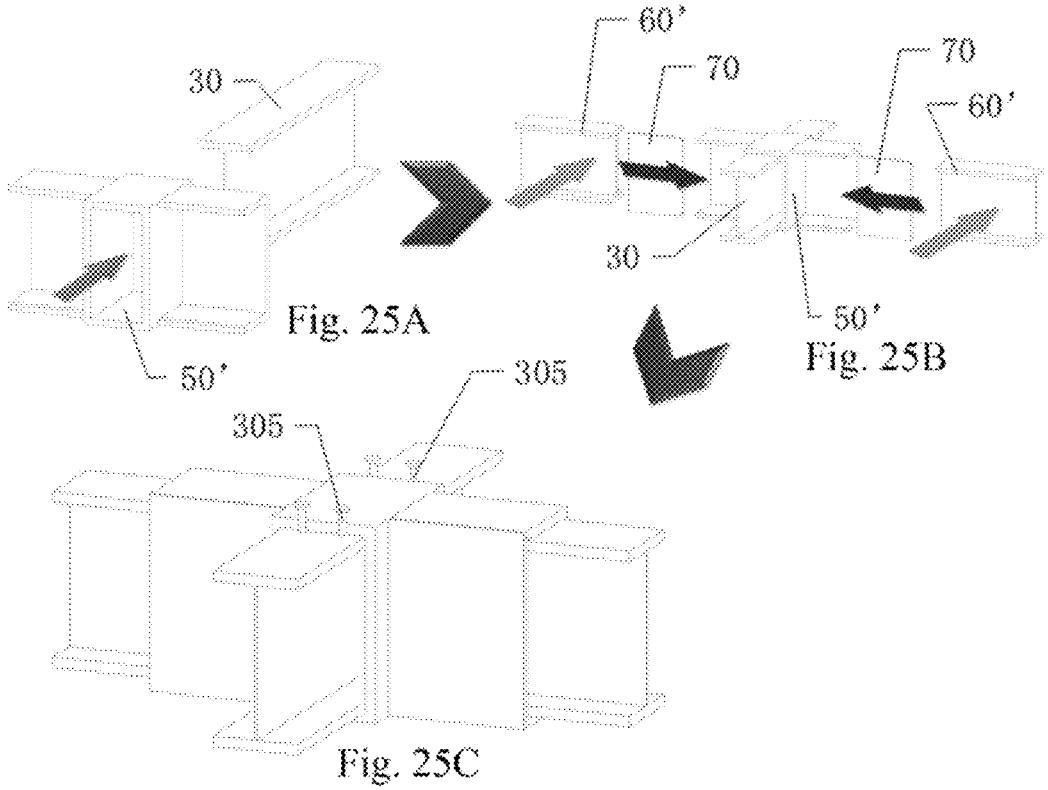
Fig. 25A
Fig. 25B
Fig. 25C
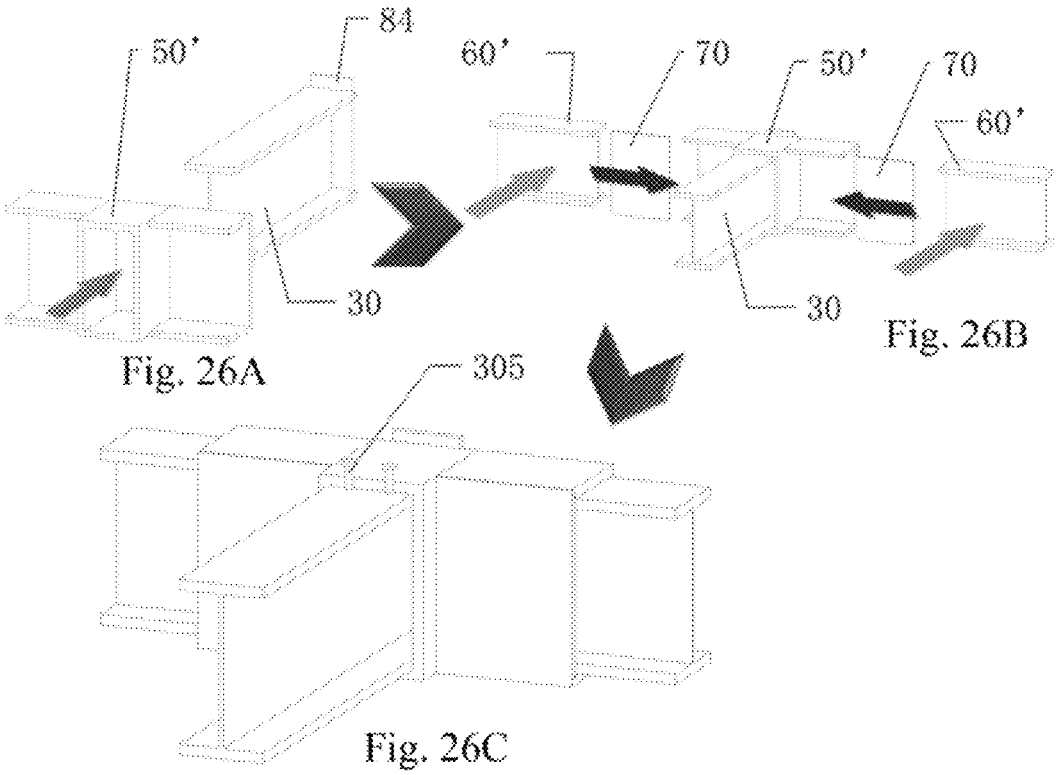
Fig. 26A
Fig. 26B
Fig. 26C

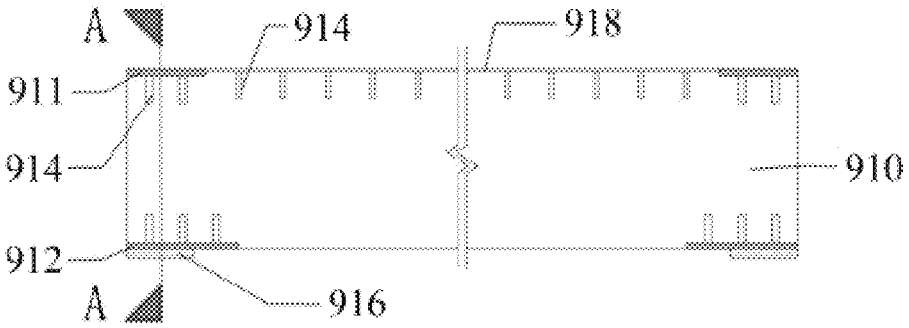
Fig. 29A
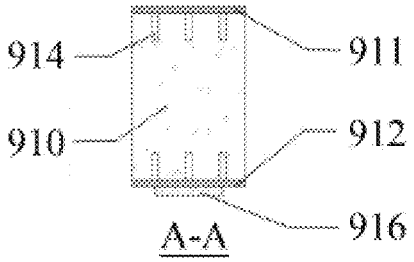
Fig. 29B
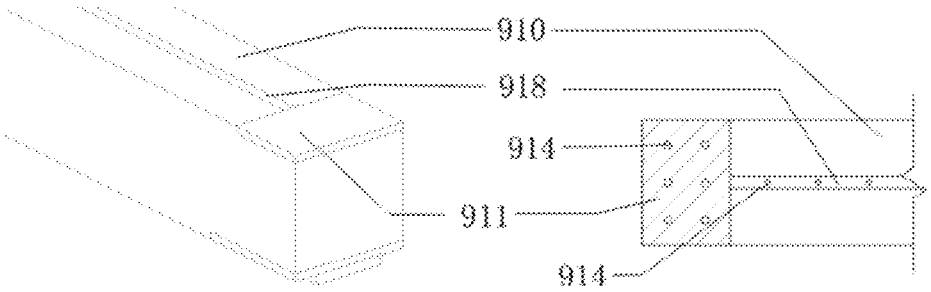
Fig. 30A
Fig. 30C
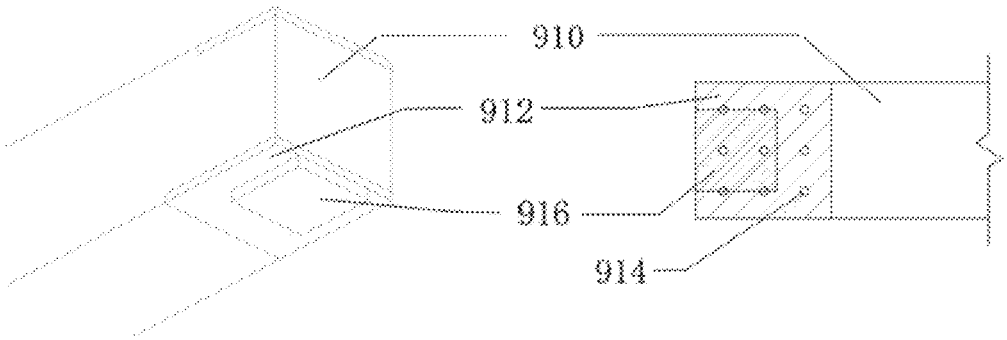
Fig. 30B
Fig. 30D

A-A

FABRICATED STRUCTURAL SYSTEM AND ASSEMBLING METHOD THEREOF

TECHNICAL FIELD

The present application relates to the technical field of structural engineering, in particular a novel prefabricated structural system and an assembling method thereof. More specifically, the present application relates to a prefabricated structural system and assembly method thereof adopts a tenon-and-mortise-like configuration as a connection for joint and can be used for steel structures, reinforced concrete structures and timber structures.

BACKGROUND

A steel structure may contain main structural members, such as columns, main beams, secondary beams and bracings, connected as an integrated structure via connecting joints.

At present, the most commonly used method for connecting joints include the use of a high strength bolt connection and welding. Generally, in a steel fabrication factory, steel members (such as, beams and columns) and connecting plates are prefabricated, the connecting plates and stiffener plates are welded, and bolt holes are drilled in advance at locations where a bolt connection is needed. Then, the prefabricated members are transported to the construction site, hoisted to proper position and subsequently connected by using high strength bolts or welding.

The above-described methods for connecting joints may suffer the following deficiencies:

1) When using the high strength bolt connection method, each joint may need dozens or even hundreds of bolt holes on the members and connecting plates, causing significant increase in the time and cost of processing.

2) Errors usually occur since components are not mass-produced in the fabrication factory. As a result, it can be difficult to connect components due to a composition of prefabrication errors caused by different components and production processes.

3) After the steel members are transported to the construction site and hoisted in place when connected by bolts, manual fixing for the bolts are required. For fixing each bolt, three working procedures may be needed: that is, temporary fixing of the bolt, an initial screwing and final screwing of the bolt, which greatly increases on-site workload and cost.

4) When connected by onsite welding, generally a preheating process needs to be performed prior to welding, which not only increases the on-site workload and cost but also easily affected by welder's experience and proficiency, the welding procedure and welding environment such as weather condition and welding position. Thus, this makes it difficult to ensure a good quality for on-site welding.

SUMMARY

To address at least one of the above disadvantages of the prior technology, the present application provides a prefabricated structural system and assembling method thereof adopting a tenon-and-mortise-like configuration as a connection for steel structure joints. In addition to steel structural construction, the pre-fabricated structural system and the assembling method thereof may be applied to reinforced concrete structures and timber structures.

One aspect of the application provides a prefabricated structural system, which may include a plurality of steel structure joints and related members. The steel structure joints and related members further includes: a beam-column connecting sleeve, including a first box-shaped steel tube and first C-shaped sleeves extending outward from and perpendicular to outer surfaces of the first box-shaped steel tube, wherein the first C-shaped sleeve is provided with first wedge shaped recesses at ends of upper and lower flanges thereof; a column having a column connecting end inserted into the first box-shaped steel tube; main beams having a main beam connecting end inserted into the first C-shaped sleeve; and main beam fixing steel plates provided with first wedge shaped protrusions that are tenon-mortise-jointed with the first wedge shaped recesses of the first C-shaped sleeve on both sides of the fixing steel plate.

In some alternative embodiments, the steel structure joints and related members may further include: a main beam-secondary beam connecting sleeve including a second box-shaped steel tube and steel connecting plates extending outward from and perpendicular to sides of the second box-shaped steel tube, wherein the steel connecting plate is provided with dovetail-shaped recesses inclined inwardly at the far end from the second box-shaped steel tube; and secondary beams including at both ends thereof dovetail-shaped protrusions that are tenon-mortise-jointed with the dovetail-shaped recesses of the steel connecting plate.

In some alternative embodiments, the steel structure joints and related members may further include: a main beam-secondary beam connecting sleeve including a second box-shaped steel tube and a second C-shaped sleeve extending outward from and perpendicular to outer surfaces of the second box-shaped steel tube, wherein the second C-shaped sleeve is provided with second wedge shaped recesses at ends of the upper and lower flanges; secondary beams having a secondary beam connecting end inserted into the second C-shaped sleeve; a secondary beam fixing steel plate provided with a second wedge shaped protrusion that is tenon-mortise-jointed with the second wedge shaped recess of the second C-shaped sleeve at both sides.

In some alternative embodiments, a restraining member may be installed on an upper surface of the main beam, the restraining member may be positioned at an intersection between the upper flange of the main beam and the both sides of the main beam-secondary beam connecting sleeve so as to fix the main beam-secondary beam connecting sleeve.

In some alternative embodiments, the restraining member may be a shear stud welded on the upper surface of the main beam.

In some alternative embodiments, the first C-shaped sleeve may be provided with a restraining groove on a bottom surface thereof and a restraining protrusion matched with the restraining groove may be provided at the bottom of the lower flange of the main beam connecting end.

In some alternative embodiments, protruding teeth may be provided at an inner surface of the first box-shaped steel tube, matching grooves corresponding to the protruding teeth may be provided at an outer surface of a column connecting end and the grooves may extend to an end surface of the column connecting end.

In some alternative embodiments, an inner horizontal stiffener may be provided within the first box-shaped steel tube, a surface of the inner horizontal stiffener being in contact with an end surface of a column connecting end.

In some alternative embodiments, the cross section of the column may be box-shaped, H-shaped or circular.

In some alternative embodiments, the cross section of the main beam may be H-shaped or box-shaped.

In some alternative embodiments, the fabricated structural system may further include a steel adhesive applied between connecting surfaces of at least one of the connecting ends.

Another aspect of the application provides a method of assembling a prefabricated structural system, including: fixing a column connecting end; connecting, from an upper end of the column, a first box-shaped steel tube of a beam-column connecting sleeve onto a column connecting end of the column; inserting the connecting end of a main beam into a first C-shaped sleeve of the beam-column connecting sleeve extending outward from and perpendicular to an outer side of the first box-shaped steel tube; and inserting a main beam fixing steel plate into the C-shaped sleeve such that a tenon-mortise joint is formed between first wedge shaped recesses provided at ends of upper and lower flanges of the first C-shaped sleeve and first wedge shaped protrusions provided at both sides of the main beam fixing steel plate, thereby restraining the main beam connecting end.

In some alternative embodiments, the method may further include: connecting a main beam-secondary beam connecting sleeve onto the main beam before inserting the main beam connecting end into the first C-shaped sleeve, and fixing the main beam-secondary beam connecting sleeve after inserting a main beam fixing steel plate into the first C-shaped sleeve; and installing a secondary beam into the main beam-secondary beam connecting sleeve.

In some alternative embodiments, installing the secondary beam into the main beam-secondary beam connecting sleeve may include: pushing the secondary beam from an upper side of the secondary beam into a steel connecting plate extending outward from and perpendicular to the second box-shaped steel tube of the main beam-secondary beam connecting sleeve, such that a tenon-mortise jointing is formed between dovetail-shaped recesses inclined inwardly at the end of the steel connecting plate and dovetail-shaped protrusions provided at the end of the secondary beam.

In some alternative embodiments, installing the secondary beam into the main beam-secondary beam connecting sleeve may include: inserting a secondary beam connecting end of the secondary beam into a second C-shaped sleeve extending outward from and perpendicular to the second box-shaped steel tube of the main beam-secondary beam connecting sleeve; and inserting a secondary beam fixing steel plate into the second C-shaped sleeve such that a tenon-mortise jointing is formed between second wedge shaped recesses provided at ends of the upper and lower flanges of the second C-shaped sleeve and second wedge shaped protrusions at both sides of the secondary beam fixing steel plate, thereby restraining the secondary beam connecting end.

In some alternative embodiments, fixing the main beam-secondary beam connecting sleeve may include: welding shear studs on an upper surface of the main beam such that the shear studs are positioned at an intersection of an upper flange of the main beam and both sides of the main beam-secondary beam connecting sleeve so as to fix the main beam-secondary beam connecting sleeve.

In some alternative embodiments, inserting the main beam connecting end into the first C-shaped sleeve may include: inserting the main beam connecting end of the main beam into the first C-shaped sleeve of the beam-column connecting sleeve laterally from the side of the main beam such that a restraining protrusion provided at bottom of the lower flange of the main beam connecting end fits into a restraining groove provided at bottom of the first C-shaped sleeve.

In some alternative embodiments, connecting the first box-shaped steel tube onto the column connecting end may include: connecting, from an upper side of the column, the first box-shaped steel tube of the beam-column connecting sleeve onto the column connecting end of the column, such that protruding teeth provided on an inner surface of the first box-shaped steel tube are engaged with grooves provided on an outer surface of the column connecting end.

In some alternative embodiments, connecting the first box-shaped steel tube onto the column connecting end may include: connecting, from a top side of the column, the first box-shaped steel tube of the beam-column connecting sleeve onto the column connecting end of the column, such that an end surface of the column connecting end comes into contact with a surface of the inner horizontal stiffener within the first box-shaped steel tube.

In some alternative embodiments, the method of assembly may further include: applying steel adhesive between connecting surfaces of at least one of the connecting ends.

In some alternative embodiments, the method of assembly may further include: inserting, from an upper side of the beam-column connecting sleeve, a connecting end of another column into the beam-column connecting sleeve, so as to repeat the installation process.

In addition to the steel structural construction, the prefabricated structural system and the assembling method thereof according to the present application may be further applied to reinforced concrete structures and timber structures.

The application may be suitable for multi-story and high-rise buildings for residential, school, office or hotel etc. and has the following advantages:

The size of the entire completed connecting sleeve is approximately 1 meter square and is light weight, and the various components of the connecting sleeve have even smaller size. This would facilitate in precision during factory fabrication, thus realizing mass and standardized production while also ensuring fabrication quality.

Given the connecting sleeve is small in size and is light weight, it is easier to transport and hoist. Therefore, deformation caused by damage, often occurring during transport or hoisting, may be avoided.

The procedures for fabricating the columns, main beams and secondary beams, and non-structural columns and non-structural beams may be simplified greatly, which shortens fabrication time and ensure fabrication quality.

When installed on site, a no-bolt and no-welding prefabricated structural system can be fully realized by using the above mentioned connecting sleeve and the pre-fabricated steel members. Therefore, it is possible to greatly reduce installation processes, shortening installation time significantly, as well as ensuring quality of construction.

Since there is no need to use bolts or welded connections, the need for highly skilled welders is reduced thereby saving on-site costs.

Through the standard modular production of members and connecting sleeves, modular design, factory production, and professional installation of the members and connecting sleeves, a stable and reliable connection and installation capability is achieved. Additionally, the disclosed system avoids the disadvantages of welding and bolting at the construction site, simplifying assembly and increasing efficiency, thereby shortening the construction time, saving costs, which may facilitate the development of prefabricated buildings.

BRIEF DESCRIPTION OF THE DRAWINGS

Other features, objectives and advantages of the present application will become apparent from the following detailed description of non-restrictive embodiments of the invention as illustrated in the accompanying drawings, wherein:

FIG. 3 is a indicative exploded-view of components of a column, a main beam and the beam-column connecting sleeve;

FIGS. 4A through 4F are indicative views of the assembling process involving the beam-column connecting sleeve, the column and the main beam;

FIGS. 5A through 7B are indicative views illustrating three ways of connection between the column and the beam-column connecting sleeve;

FIGS. 8A through 8B are indicative views of strengthening the interlocking connection between the column and the beam-column connecting sleeve;

FIGS. 14A through 17C are indicative views illustrating four ways of connection between a main beam (a cantilever beam configuration) and the secondary beam according to the first exemplary embodiment;

FIGS. 18A through 18C are indicative views illustrating the installation of the connection between the secondary beam and the main beam according to the first exemplary embodiment;

FIGS. 19A through 19C are indicative views illustrating the installation of the connection between the secondary beam and the cantilever beam according to the first exemplary embodiment;

FIGS. 20A through 20B are indicative views of an enlarged portion of the secondary beam and the main beam-secondary beam connecting sleeve according to a second exemplary embodiment in which a second main beam-secondary beam connecting sleeve is applied;

FIGS. 25A through 25C are indicative views illustrating the installation of the connection between the secondary beam and the main beam according to the second exemplary embodiment;

FIGS. 26A through 26C are indicative views illustrating the installation of the connection between the secondary beam and the cantilever beam according to the second exemplary embodiment;

FIGS. 29A through 29B are indicative elevation views of a precast reinforced concrete beam;

FIGS. 30A through 30D are enlarged indicative views of the end portion of the precast reinforced concrete beam;

LIST OF THE REFERENCE NUMERALS

Figure 1:
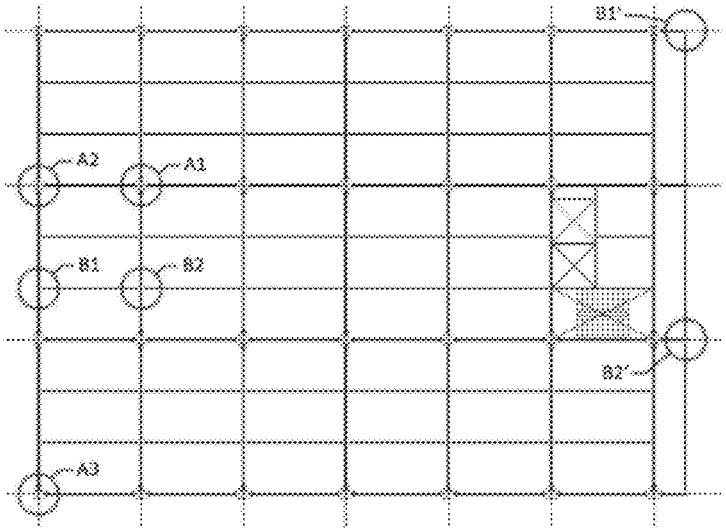
FIG. 1 is a structural framing plan of a multi-floor (typical floor) steel frame structure.

10 Beam-column connecting sleeve
101 First box-shaped steel tube
102 First C-shaped sleeve
103 First wedge shaped recess
104 Restraining groove
105 Horizontal inner stiffener
105' Vertical inner stiffener
106 Protruding teeth
20 Column
201 Column connecting end
206 Groove
30 Main beam
301 Main beam connecting end
304 Restraining protrusion
305 Shear stud
40 Main beam fixing steel plate
403 First wedge shaped protrusion
50/50' Main beam-secondary beam connecting sleeve
501/501' Second steel box
502 Steel connecting plate
503 Dovetail-shaped recess
504 Second C-shaped sleeve
505 Second wedge shaped recess
60/60' Secondary beam
601 Secondary beam connecting end
603 Dovetail-shaped protrusion
70 Secondary beam fixing steel plate
705 Second wedge shaped protrusion
80 Steel wedge
81 Bracing connection
82 Column stiffener
83 Stiffener
84 Steel end plate
85 Main beam stiffener
900 Reinforced concrete column
902 Pre-embedded steel plate
904 Anchoring reinforcement bar
906 Protruding rib
910 Reinforced concrete beam
911 Pre-embedded steel plate
912 Pre-embedded steel plate
914 Anchoring reinforcement bar
916 Anti-slip steel plate
918 Pre-embedded narrow steel plate
920 Timber structural beam
924 Steel bolt/steel nail
928 Anti-slip steel plate

DETAILED DESCRIPTION

Various aspects of the present application will be described in detail in connection with the accompanying drawings, in order to provide a better understanding of the present application. It should be appreciated that these detailed descriptions are merely illustrative of exemplary embodiments of the present application, rather than restraining the scope of the present application. Throughout the specification, the same reference numerals refer to the same elements. The expression "and/or" includes any and all combinations of one or more of the associated listed items.

It should be understood that, although the terms first, second, etc. may be used herein to describe various elements, components or sections, these elements, components or sections should not be limited by these terms. These terms are merely used to distinguish one element, component or section from another element, component or section. Thus, for example, a first box-shaped sleeve, a first C-shaped sleeve, a first protrusion, a first recess discussed below could be termed as a second box-shaped sleeve, a second C-shaped sleeve, a second protrusion, a second recess without departing from the teachings of the present application.

In the accompanying drawings, the sizes and shapes of some of the elements, components or sections may be exaggerated for ease of explanation. The accompanying drawings are merely examples rather than strictly to scale.

It is also to be understood that the terms "includes", "including", "having", "comprises" and/or "comprising", when used in this specification, indicate the presence of stated features, steps, operations, elements and/or components, but do not preclude the presence or addition of one or more other features, steps, operations, elements, components and/or combination thereof. Also, a representation such as "at least one of . . . ", when used behind a list of listed features, modifies the entire of the listed features, rather than the individual elements in the list. In addition, when describing the embodiments of the present application, the term "may" is used to indicate "one or more embodiments of the present application." Also, the term "exemplary" is intended to refer to an example or to illustrate.

As used herein, the terms "substantially", "approximately", and the like are used as terms represented approximation rather than degree, and are intended to illustrate the inherent deviations of measured values or calculated values that will be recognized by those of ordinary skill in the art.

Unless otherwise defined, all terms (including technical and scientific terms) used herein have the same meaning as commonly understood by one of ordinary skill in the art to which the present application belongs. It will also be understood that terms, such as those defined in commonly used dictionaries, should be interpreted as having meanings that is consistent with their meanings in the context of the relevant art and will not be interpreted in an idealized or overly formal sense, unless expressly limited so herein.

It should be noted that, in the case of not being conflict, embodiments in the present application and the features in the embodiments may be combined with each other. The present application will be described in detail below with reference to the accompanying drawings and the embodiments.

The present application will be further described below with reference to specific embodiments.

FIG. 1 is a structural framing plan of a multi-floor (typical floor) steel frame structure. Connection joints A1, A2, A3, B1, B1', B2, B2' shown in FIG. 1 will be described later.

Referring to FIG. 1, the steel frame structure typical arrangement includes a plurality of minimal elements (also referred to as steel structure joints and related members). At the central portion of the steel frame structure each steel structure joint and related members have approximately the same configuration; and at the edge of the steel frame structure, except for the number of main beams, secondary beams and columns being different, the steel structure joint and related members have the same configuration as that of the central portion of the steel frame. Therefore, in order to reduce repetitiveness, the description will primarily focus on the steel structure joints and related members at the central portion of the steel frame structure, and the description of the steel structure joints and related members at the edge is simplified.

Figures 2A, 2B:
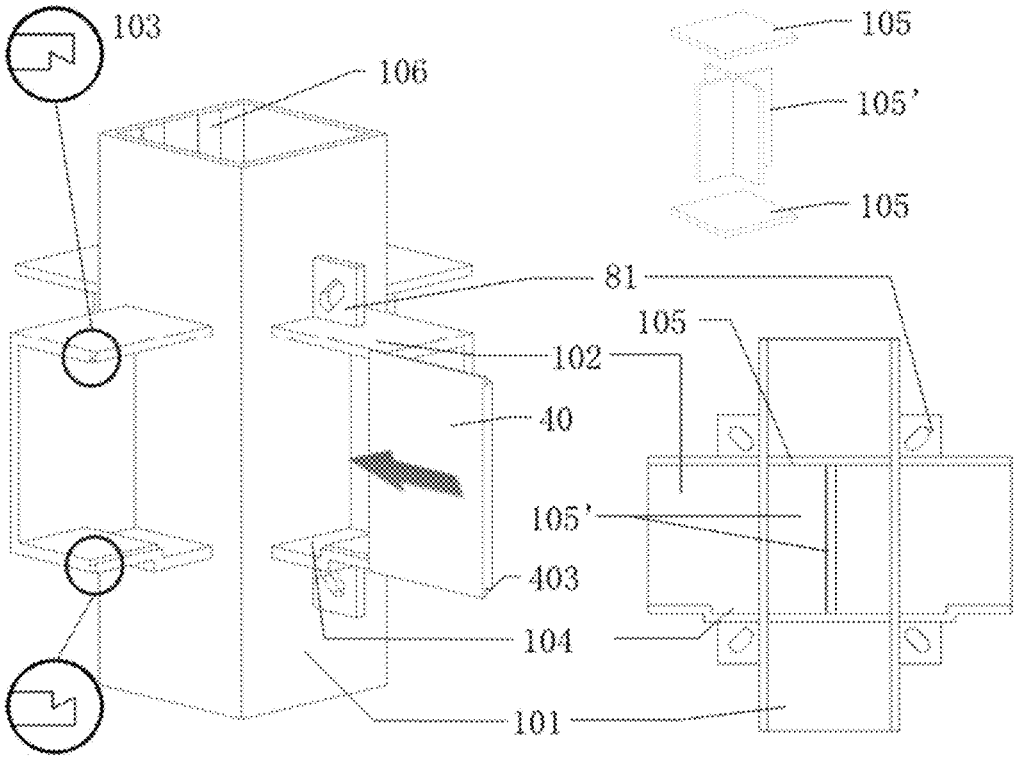
FIGS. 2A and 2B include a three-dimensional view and a longitudinal cross-sectional view of a beam-column connecting sleeve.

FIGS. 2A through 3 illustrate steel structure joints and related members according to an embodiment of the present application. In particular, FIGS. 2A through 2B include a 3D view and longitudinal cross-sectional views of a beam-column connecting sleeve; and FIG. 3 is a indicative exploded view of components of column, main beam and the beam-column connecting sleeve.

In this embodiment, the prefabricated structural system includes a plurality of steel structure joints and related members. The steel structure joints and related members further includes: a beam-column connecting sleeve 10, comprising a first box-shaped steel tube 101 and first C-shaped sleeves 102 extending outward from and perpendicular to outer surfaces of the first box-shaped steel tube 101, wherein the first C-shaped sleeve 101 is provided with first wedge shaped recesses 103 at ends of upper and lower flanges thereof; columns 20, having a column connecting end 201 inserted into the first box-shaped steel tube 101; main beams 30, having a main beam connecting end 301 inserted into the first C-shaped sleeve 102; and main beam fixing steel plates 40, provided with first wedge shaped protrusions 403 that are tenon-mortise-jointed with first wedge shaped recesses 103 of the first C-shaped sleeve 102 at both sides of the first C-shaped sleeve 102.

It should be noted that the number of the first C-shaped sleeves may be one or more than one, and the number of columns may be one column (e.g., a lower column), or two columns (e.g., an upper column and a lower column) depending on specific configuration. Such quantities serve as example possibilities and the present application is not restricted to these quantities.

As shown in FIGS. 2A through 3, the beam-column joint may be connected by using, for example, a beam-column connecting sleeve in a tenon-and-mortise-like configuration and prefabricated at a steel fabrication plant. This sleeve may be used to connect the upper and lower columns as well as the column and the main beam.

In an alternative embodiment, as shown in FIGS. 2A through 3, the first C-shaped sleeve 102 may be provided with a restraining groove 104 on a bottom surface thereof; correspondingly, the main beam connecting end 301 may be provided with a restraining protrusion 304 mated with the restraining groove 104 at the bottom of the lower flange, and the restraining protrusion 304 is distinctly shown in FIGS. 9A through 12B. When the main beam connecting end 301 of the main beam 30 is inserted into the first C-shaped sleeve 102, the restraining protrusion 304 mated with the restraining groove 104, thereby restricting the movement of the main beam 30 relative to the beam-column connecting sleeve 10 in the direction of extension of main beam 30.

In an alternative embodiment, the restraining protrusion 304 is in a form of a steel plate and is welded in advance onto the bottom surface of the main beam connecting end 301 of the main beam 30.

In an alternative embodiment, an inner stiffener 105 and an inner stiffener 105' may be provided within the first box-shaped steel tube 101, wherein the inner stiffener 105 may be horizontally disposed and the inner stiffener 105' may be vertically disposed. In this embodiment, two inner stiffeners for stiffening may be provided within the first box-shaped steel tube 101 at positions corresponding to the upper and lower flanges of the first C-shaped sleeve 102. When the column 20 is inserted into the first box-shaped steel tube 101, end surfaces of the column connecting end 201 of the column 20 may come to contact with surfaces of the inner stiffener 105.

In an alternative embodiment, as shown in FIGS. 2A through 2B, the beam-column connecting sleeve 10 may further include a bracing connection 81.

Although specific dimensions of the first box-shaped steel tube and the first C-shaped sleeve are illustrated in the accompanying drawings, it should be understood that such dimensions are merely exemplary embodiments and not a restriction. The dimensions of the first box-shaped steel tube and the first C-shaped sleeve can vary depending on the size of the upper and lower columns and the main beam to be connected without departing from the scope of the application.

In this embodiment, the main beam, the beam-column connecting sleeve and the column are made of steel. In addition, although the drawings show the cross section of the column as H-shaped, the H-shape is merely an exemplary example and not a restriction. For example, the cross-section of the column may also be box-shaped or circular. Similarly, although the drawings show the cross-section of the main beam as H-shaped, this is not a restriction and the cross section of the main beam may also be box-shaped.

The assembly process of the beam-column connecting sleeve 10, the column 20, the main beam 30 and the main beam fixing steel plate 40 will be described below with reference to FIGS. 4A through 4F.

It should be understood that only the assembly method of a minimum unit (i.e., steel structure joints and related members) in a central portion of the prefabricated structural system is shown herein, and the assembling methods of other steel structure joints and related members in the system can be repeated or similar thereof—but is not described herein for the consideration of concise description.

In this embodiment, the assembling method of the prefabricated structural system includes: fixing a fixed end of a column 20; connecting, from an upper side of the column 20, a first box-shaped steel tube 101 of a beam-column connecting sleeve 10 onto a column connecting end 201 of the column 20; inserting a main beam connecting end 301 of a main beam 30 into a first C-shaped sleeve 102 of the beam-column connecting sleeve 10 extending outward from and perpendicular to an outer side of the first box-shaped steel tube 101; and inserting a main beam fixing steel plate 40 into the C-shaped sleeve 102 such that a tenon-mortise mating is formed between first wedge shaped recesses 103 provided at ends of upper and lower flanges of the first C-shaped sleeve 102 and first wedge shaped protrusions 403 provided at both sides of the main beam fixing steel plate 40, thereby restraining the main beam connecting end 301.

Specifically, as shown in FIGS. 4A through 4F, after the lower column 20 is installed, the beam-column connecting sleeve 10 may be connected onto the top portion of the lower column 20; then the main beam 30 may be inserted into the first C-shaped sleeve 102; after that, the main beam fixing steel plate 40 may be inserted into the first C-shaped sleeve 102 such that a tenon-and-mortise joint is formed between the first wedge shaped recess 103 and the first wedge shaped protrusions 403 thereby restraining the main beam 30; and finally, the upper column 20 is inserted into the beam-column connecting sleeve 10, from an upper side thereof, thus completing the assembly process.

In an alternative embodiment, during installing process, the method may include: connecting the main beam-secondary beam connecting sleeve 50 onto the main beam 30 prior to inserting the main beam connecting end 301 into the first C-shaped sleeve 102 and fixing the main beam-secondary beam connecting sleeve 50 after inserting the main beam fixing steel plate 40 into the first C-shaped sleeve 102; and installing the secondary beam 60 into the main beam-secondary beam connecting sleeve 50. Since the main beam-secondary beam connecting sleeves may have different configurations, the secondary beam and the main beam-secondary beam connecting sleeves may involve different installing methods, which will be described in detail later in the specification.

In an alternative embodiment, during the installing process, the method may include: in connecting the first box-shaped steel tube 101 of the beam-column connecting sleeve 10 onto the column connecting end 201 of the column from the top side, providing contact between the end surface of the column connecting end 201 and the surface of the inner stiffener 105 arranged within the first box-shaped steel tube 101.

In an alternative embodiment, a steel wedge 80 may be used to adjust and secure the position of the column, as shown in FIGS. 4A through 4F. In the cases where the cross section of the column may be H-shaped, box-shaped or circular, the beam-column connecting sleeve may be implemented basically in the same way, thereby facilitating mass production in factory.

Next, the connection between the column connecting end of the column and the beam-column connecting sleeve will be described with reference to FIGS. 5A through 8B. Depending on the locations of the steel structure joints and related members in the structural system, the beam-column connecting sleeve may have different forms.

Figure 5A:
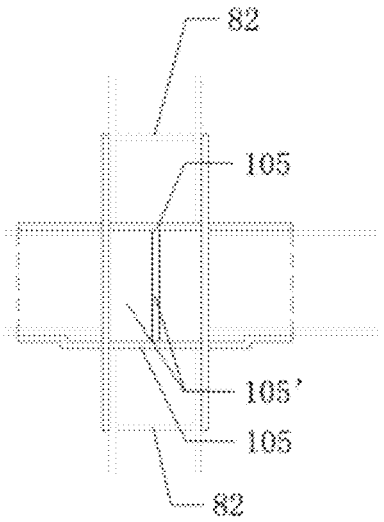
Figure 5B:
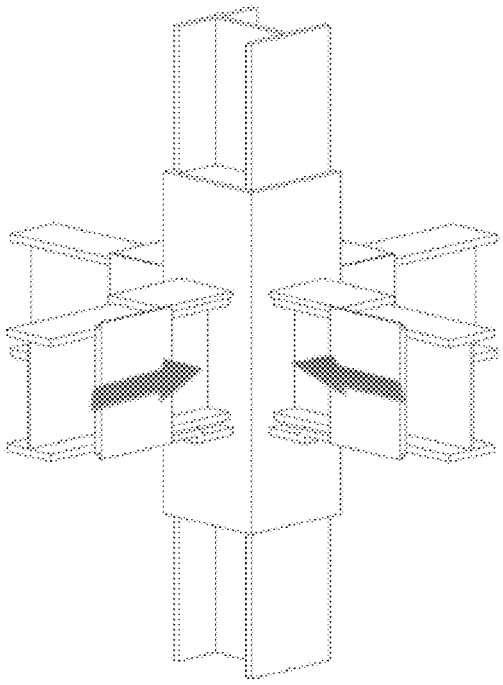
Figure 6A:
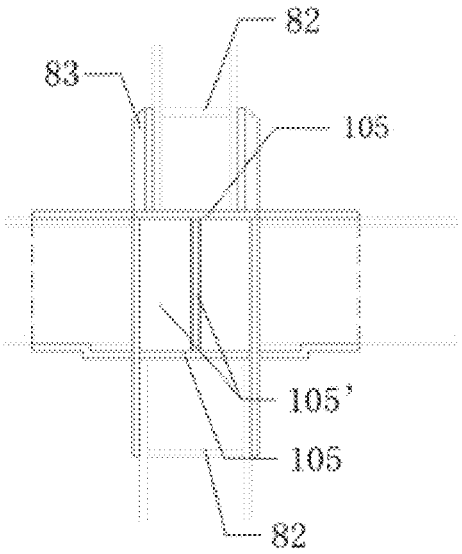
Figure 6B:
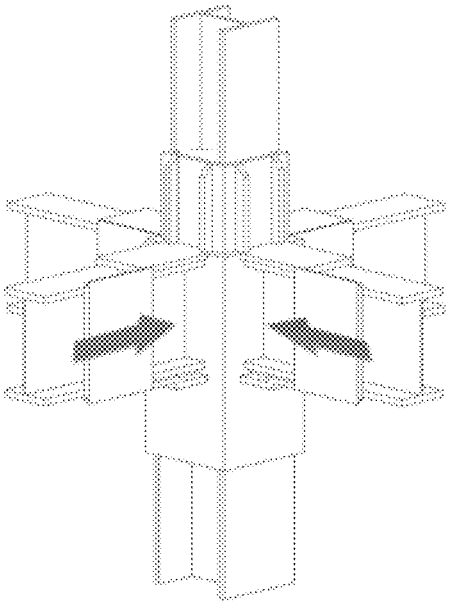

As shown in FIGS. 5A through 7B, the ways of connecting columns 20 to the beam-column connecting sleeve 10 include the following three configurations: the upper and lower columns are the same size (as shown in FIGS. 5A through 5B); the upper column is relatively smaller than the lower column (as shown in FIGS. 6A through 6B); the column is in the top floor (as shown in FIGS. 7A through 7B).

When the upper column is of smaller size relative to the lower column, a longitudinal stiffener 83 (as shown in FIGS. 6A through 6B) may be provided on the outside of the upper end portion of the beam-column connecting sleeve 10, in order to improve the reliability of the transfer of force between the joint sleeves. At the end of each column to be connected which corresponds to the height of the opening of the beam-column connecting sleeve 10, a horizontal stiffener 82 (as shown in FIGS. 5A through 7B) may be installed within the column as required.

When the fabrication accuracy is insufficient or the reliability of connection between the beam-column connecting sleeve and the upper and lower columns thereof is expected to be further improved, "teeth" may be prefabricated in a factory on the inner surface of the first box-shaped steel tube of the beam-column connecting sleeve, and a "groove" may be prefabricated in a factory on the outer surface of the column flange that is inserted into the first box-shaped steel tube, thereby enhancing the interlocking force between the column and the beam-column connecting sleeve.

FIGS. 8A through 8B illustrate indicative views of an enhanced interlocking connection between a column and a beam-column connecting sleeve with respect to columns having H-shaped and box-shaped cross-sections respectively.

In an alternative embodiment, the inner surface of the first box-shaped steel tube 101 may be provided with protruding teeth 106 and, the outer surface of the column connecting end 201 may be provided with a groove 206 correspondingly matched with the protruding teeth 106, wherein the groove 206 can extend to the end of the outer surface of the column connecting end 201 (as shown in FIG. 3).

Accordingly, the assembling process may further include: connecting the first box-shaped steel tube 101 onto the column connecting end 201 of the column 20, mating the protruding teeth 106 provided on the inner surface of the first box-shaped steel tube 101 onto the groove 206 provided on the outer surface of the column connecting end 201.

In this embodiment, two grooves 206 (or protruding teeth 106) although not limited to this configuration, may be spaced apart from each other. For example, a single groove 206 (or protruding teeth 106) may be provided. In addition, the grooves 206 (or protruding teeth 106) can take on other cross sectional shapes, as long as they can be mated with each other to restrain the position of the column.

In an alternative embodiment, the depth (or height) of the groove 206 (or protruding teeth 106) may be 5 mm, although not limited thereto.

In addition, it is also possible, if needed, to apply steel adhesive between connecting surfaces of at least one of the connecting ends. For example, the steel adhesive may be applied to the connecting surfaces between the column connecting end and the beam-column connecting sleeve, and/or the main beam connecting end and the beam-column connecting sleeve, and/or the secondary beam (which will be described in detail later) and the main beam-secondary beam connecting sleeve. By applying the steel adhesive, the reliability of the connection is further increased, and the energy dissipation ability of the structural system during an earthquake is improved.

In this embodiment, with the engagement between the groove 206 and the protruding teeth 106, the precaution not only can strengthen the connection and restrain the position of the column, but also can improve the setting accuracy of the column, so as to ensure assembly precision of the overall system.

Next, with reference to FIGS. 9A through 12B, the connection between the main beam connecting end of the main beam and the beam-column connecting sleeve will be described. The beam-column connecting sleeve may vary in form, depending on the location of the steel structure joint and related members in the structural system.

Figure 9A:
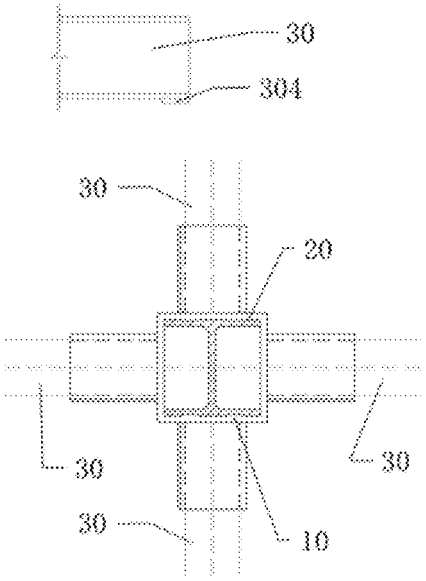
FIGS. 9A through 11B are indicative views illustrating three ways of connection between the main beam and the beam-column connecting sleeve.
Figure 9B:
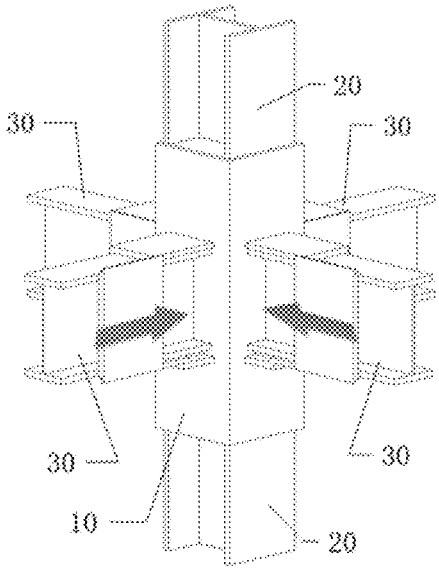
Figure 10A:
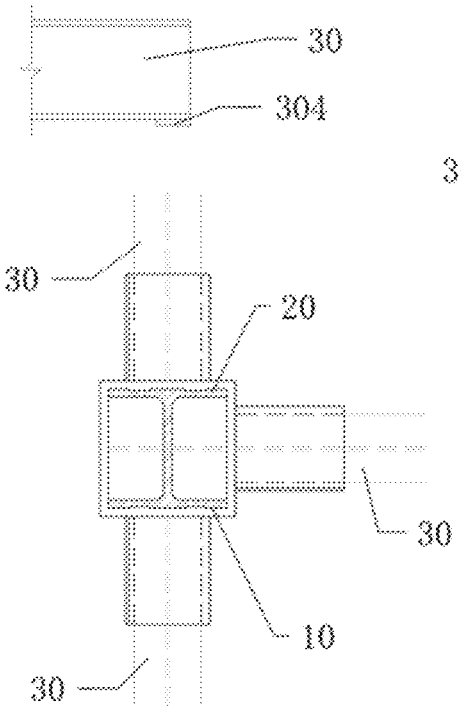
Figure 10B:
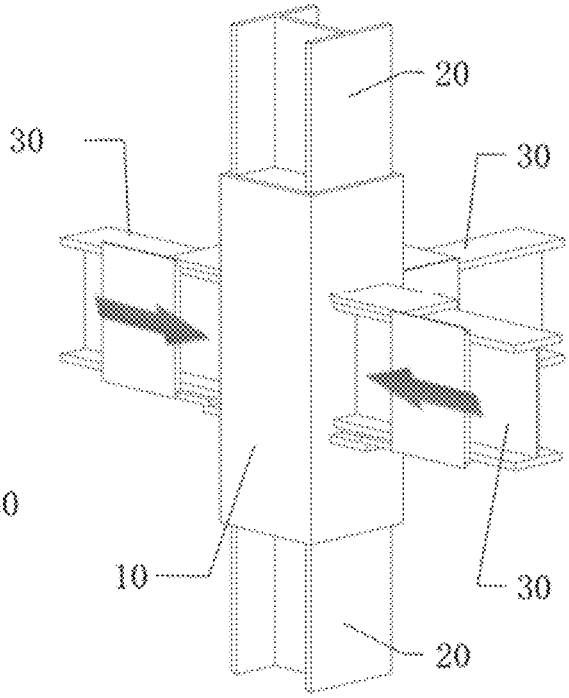
Figure 11A:
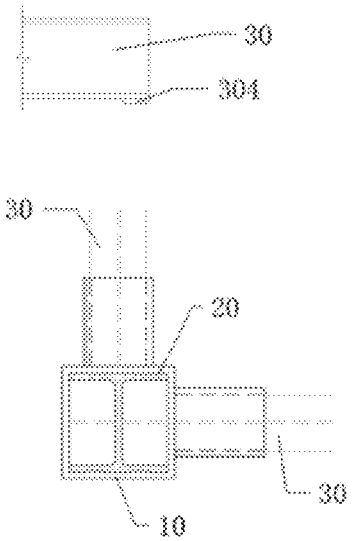
Figure 11B:
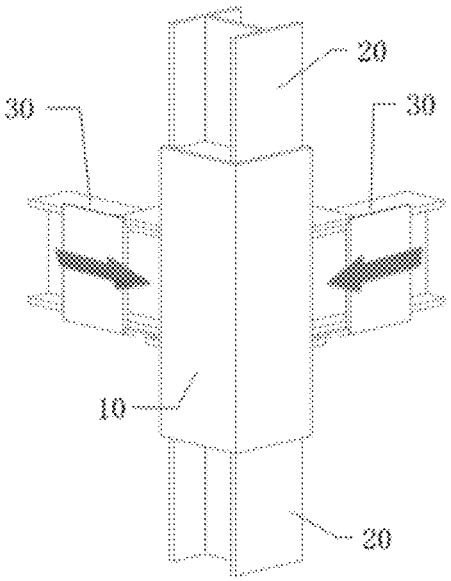

As shown in FIGS. 9A through 11B, connecting the beam to the beam-column connecting sleeve 10 includes the following three configurations: a center column configuration (as shown in FIGS. 9A through 9B corresponding to A1 in FIG. 1); a side column configuration (as shown in FIGS. 10A through 10B corresponding to A2 in FIG. 1); and a corner column configuration (as shown in FIGS. 11A through 11B corresponding to A3 in FIG. 1). Methods of assembly for these three configurations are similar, and therefore, the description provided below is in reference to the examples illustrated in FIGS. 12A and 12B.

Figure 12A:
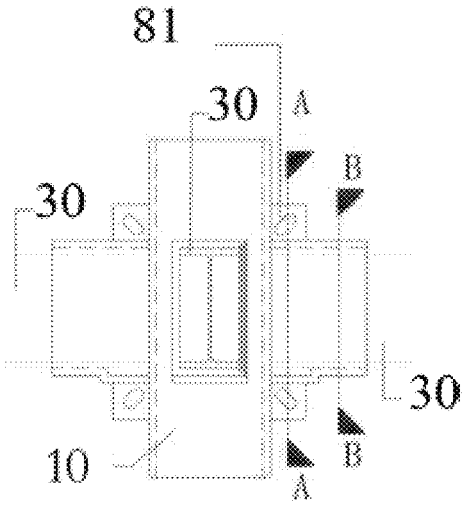
FIGS. 12A through 12B are indicative elevation views of the main beam and the beam-column connecting sleeve after installation.
Figure 12B:
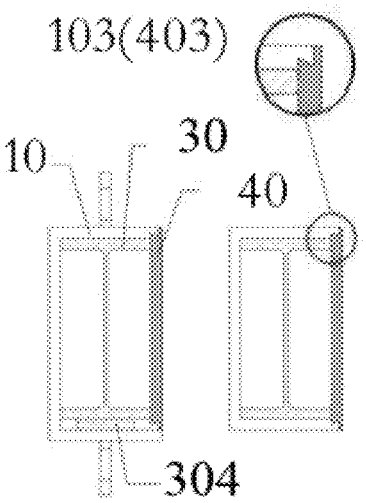

FIGS. 12A through 12B are indicative elevation views of the main beam and the beam-column connecting sleeve after installation. Although the cross section of the main beam is shown as H-shaped, it should be understood that the cross section may also be box-shaped.

The main beam is welded in advance with a steel plate at the end of the bottom of the lower flange to form a restraining protrusion 304.

In an alternative embodiment, the assembly method may include: Upon inserting the main beam connecting end 301 into the first C-shaped sleeve 102, the main beam connecting end 301 of the main beam 30 is pushed into the first C-shaped sleeve 102 which perpendicularly protrudes from the outside of the first box-shaped steel tube 101 laterally from the side such that the restraining protrusion 304 provided at the bottom of the lower flange of the main beam connecting end 301 can engage with the restraining groove 104 provided on the bottom surface of the first C-shaped sleeve 102.

Specifically, as shown in FIG. 12A through 12B, when the main beam is installed on site, the main beam connecting end 301 of the main beam 30 is first hoisted in place and is pushed into the first C-shaped sleeve of the beam-column connecting sleeve 10 laterally from the side of the sleeve 10, such that the restraining protrusion 304 on the bottom surface of the lower flange of the main beam connecting end 301 of the main beam 30 is mated with the restraining groove 104 on the bottom surface of the root of the first C-shaped sleeve 102, so as to prevent the main beam from dislocations caused by slipping when the main beam is under tension. Then, the main beam fixing steel plate 40 provided with the wedge shaped protrusion 403 is horizontally inserted into the wedge shaped recess (or gap) 103 at the open side of the first C-shaped sleeve, so as to prevent the main beam from lateral movement.

In addition to transfering bending moment and shear force to the joints in the case of an earthquake, the main beam also transfers horizontal tension or compression force to the joints. Structural steel adhesive may be further coated onto the connecting surfaces between the H-shaped steel beam and the sleeve, to enhance the ability of transferring horizontal force at joints, as well as improving energy dissipation ability of the structural system during an earthquake.

The assembling method and related configurations of the main beam, the main beam-secondary beam connecting sleeve, and the secondary beam will be described below. In the present application, the main beam-secondary beam connecting sleeves have two configurations corresponding to the first main beam-secondary beam connecting sleeve and the second main beam-secondary beam connecting sleeve respectively. The two configurations are described below.

Figure 13:
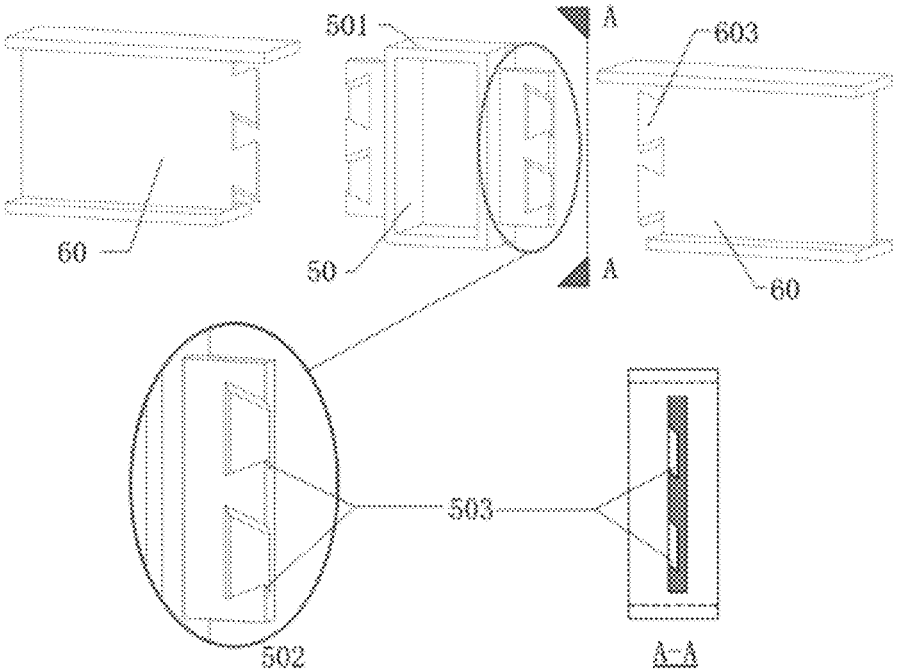
FIG. 13 is a indicative view of an enlarged portion of a secondary beam and a main beam-secondary beam connecting sleeve according to a first exemplary embodiment in which a first main beam-secondary beam connecting sleeve is applied.

The configuration of a secondary beam and a main beam-secondary beam connection sleeve and the process of attaching them with the main beam, according to the first exemplary embodiment involving the implementation of the main beam-secondary beam connection sleeve, will be described below with reference to FIGS. 13 through 19C. FIG. 13 illustrates an exploded indicative view of components of a secondary beam and a main beam-secondary beam connecting sleeve according to the first exemplary embodiment in which a first main beam-secondary beam connecting sleeve is implemented. The main beam-secondary beam connecting sleeve adopts a dovetail form which may be used to connect the main beam and the secondary beam. In an embodiment, the main beam, the main beam-secondary beam connecting sleeve, and the secondary beam may be made of steel. In alternative embodiments, the steel structure joints and related members may also include a main beam-secondary beam connecting sleeve 50 (i.e., the first main beam-secondary beam connecting sleeve in the first exemplary embodiment) and a secondary beam 60, wherein the first main beam-secondary beam connecting sleeve 50 includes a second box-shaped steel tube 501 and a steel connecting plate 502 perpendicular to and extending outward from the side of the second box-shaped steel tube 501. The steel connecting plate 502 is provided with a dovetail-shaped recess 503 inclined inwardly at the far end from the second box-shaped steel tube 501. The secondary beam 60 is provided at its two ends a dovetail-shaped protrusion 603 combining as a tenon-and-mortise joint with the dovetail-shaped recess 503 of the steel connecting plate 502.

Specifically, as shown in FIG. 13, the main beam-secondary beam connecting sleeve 50 is composed of a short box-shaped steel tube and a steel connecting plate 502 provided with a dovetail-shaped recess 503 inclined inwardly and the plate 502 is fixed on one or both sides of the steel tube. However, it should be noted that this number is only an example and does not serve as a limitation for the number of steel connection plates 502. The dovetail-shaped recess 503 inclined inwardly of the steel connecting plate 502 may prevent the connected secondary beam 60 from sliding out of position, as portions of the connected secondary beams 60 including at both ends a dovetailed protrusion 603 for engaging with the steel connecting plate 502 of the main beam-secondary beam connecting sleeve 50 are prefabricated in factory In an alternative embodiment, as shown in FIGS. 18A through 18C, a restraining member (e.g., shear stud) 305 is provided on the upper surface of the main beam 30. The shear stud 305 is positioned on an intersection between the upper flange of the main beam 30 and the both sides of the main beam-secondary beam connecting sleeve 10, so as to fix the main beam-secondary beam connecting sleeve 10. Accordingly, in an alternative embodiment, fixing the main beam-secondary beam connecting sleeve 50 includes: providing a restraining member (for example, a welded shear stud) 305 at an intersection between the upper flange of the main beam 30 and the main beam-secondary beam connecting sleeve 50, so as to fix the second box-shaped steel tube 501 of the main beam-secondary beam connecting sleeve 50. In this embodiment, the height and number of shear studs 305 merely serve as examples and not limitation, and the system may be arranged in one, two, or more rows depending on the particular needs.

With this configuration, it is possible to prevent the second box-shaped steel tube from sliding in the direction of the main beam, so as to restrain the relative movement between the main beam and the main beam-secondary beam connecting sleeve.

Next, the connection between the main beam and the secondary beam will be described with reference to FIGS. 14A through 17C. The beam assembly may include different forms depending on their positions in the structural system. It should be noted that, although the cross sections of the main beam and the secondary beam are shown as H-shaped in the drawings, in practice, the cross section of the main beam may also be box-shaped.

Figure 14A:
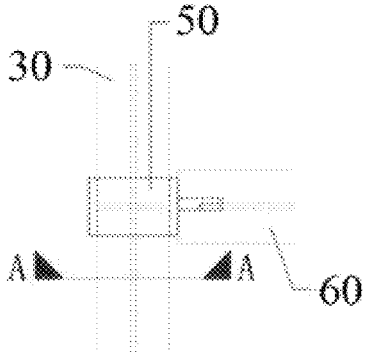
Figure 14B:
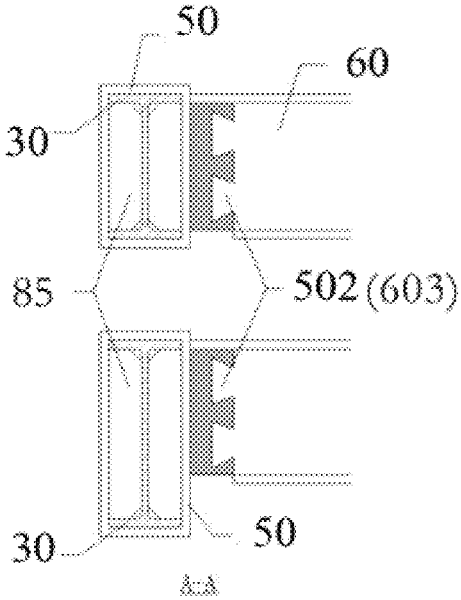
Figure 15A:
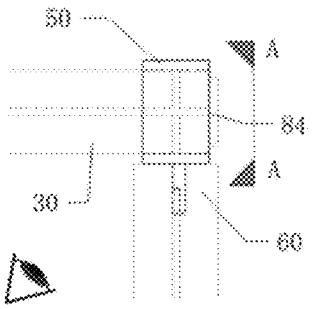
Figure 15B:
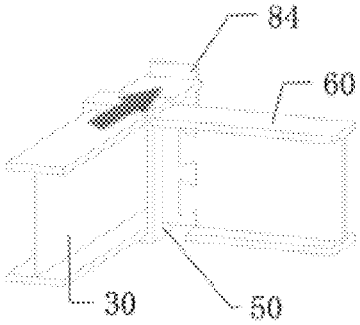
Figure 15C:
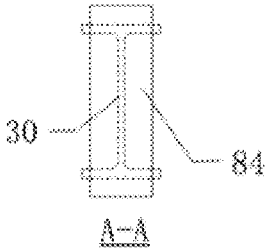

As shown in FIGS. 14A through 17C, connecting the main beam (a cantilevered beam) with the secondary beam includes the following four configurations: a main beam with one secondary beam to be connected at one side of the main beam (as shown in FIGS. 14A through 14B corresponding to B1 in FIG. 1); a cantilevered beam with one secondary beam to be connected at one side of the cantilevered beam (as shown in FIGS. 15A through FIG. 15C corresponding to B1' in FIG. 1); a main beam with two secondary beam to be connected at both sides of the main beam (as shown in FIGS. 14A through 14B and FIGS. 16A through 16B corresponding to B2 in FIG. 1); and a cantilevered beam with two secondary beam to be connected at both sides of the cantilevered beam (as shown in FIGS. 17A through 17C corresponding to B2' in FIG. 1).

Figure 16A:
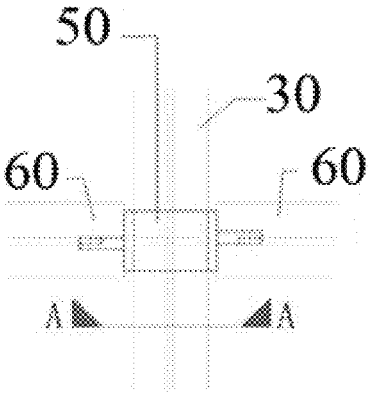
Figure 16B:
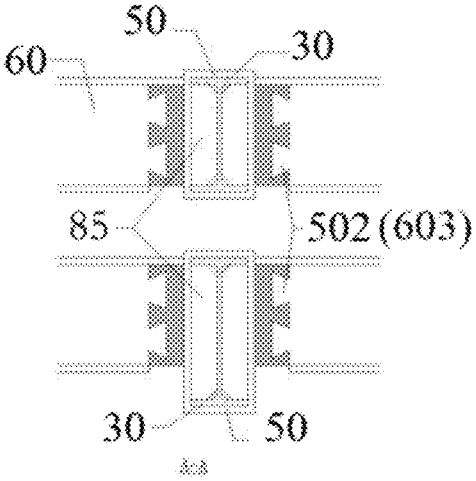

As shown in FIGS. 16A through 16B, a horizontal stiffener plate 85 may be provided in the main beam 30 if needed. As shown in FIGS. 17A through 17C, a steel end plate 84 may be installed in advance at the end of the cantilevered beam, in order to fix the main beam-secondary beam connecting sleeve 50.

Since the methods of assembly for these four configurations are similar, the following description will be made with reference to the examples provided in FIGS. 18A through 18C. FIGS. 18A through 18C show an assembly process of the secondary beam and the main beam according to an embodiment of the present application.

In an alternative embodiment, the installation of the secondary beams 60 into the main beam-secondary beam connecting sleeve 50 includes: pushing from an upper side of the secondary beams 60 into the steel connecting plate 502, forming a tenon-and-mortise joint between the dovetail-shaped recess 503 inclined inwardly at the end of the steel connecting plate 502 and the dovetail-shaped protrusion 603 provided at the end of the secondary beam 60, the steel connecting plate 502 extends outward from and perpendicular to the second box shaped steel tube 501 of the main beam-secondary beam connecting sleeve 50.

Specifically, as shown in FIG. 18A through FIG. 18C, before the H-shaped main beam is installed, the main beam-secondary beam connecting sleeve 50 may be connected onto the main beam 30; after hoisting the H-shaped secondary beam 60 in place, the beam 60 may be pushed into the dovetail-shaped recess 503 wherein the recess 503 is inclined inwardly on the side of the main beam-secondary beam connecting sleeve 50, so as to form a tenon-and-mortise joint.

FIGS. 19A through 19C illustrate another similar assembly process between the connection of the cantilevered beam and the secondary beam as an example. The assembly of connecting the cantilevered beam end with the secondary beam is similar as those shown in FIGS. 18A through 18C, except that prior to onsite assembly the end of the cantilevered beams requires welding with a steel end plate in factory beforehand to restrain the position of the main beam-secondary beam connecting sleeve. For consideration of concise description, the description of such will not be repeated herein.

Next, the configuration of the secondary beam and the main beam-secondary beam connecting sleeve as well as the installation process for connecting them with the main beam, according to a second exemplary embodiment which pertains to a second main beam-secondary beam connecting sleeve configuration, will be described with reference to FIGS. 20A through 26C. FIGS. 20A through 20B show indicative exploded views of components of the secondary beam and the main beam-secondary beam connecting sleeve according to the second exemplary embodiment in which a second main beam-secondary beam connecting sleeve is applied. A second main beam-secondary beam connecting sleeve similar to the beam-column connecting sleeve may be used to connect the main beam and the secondary beam. A main beam-secondary beam connecting sleeve taking on the form of a tenon-and-mortise joint may be used to connect the main beam with the secondary beam.

In alternative embodiments, the steel structure joint and related members may also include a main beam-secondary beam connecting sleeve 50' (i.e., a second main beam-secondary beam connecting sleeve in the second exemplary embodiment), a secondary beam 60' and a secondary beam fixing steel plate 70. The main beam-secondary beam connecting sleeve 50' includes a second box-shaped steel tube 501' and a second C-shaped sleeve 504 extending from and perpendicular to the outer surface of the second box-shaped steel tube 501'. The second C-shaped sleeve 504 is provided with second wedge shaped recesses 505 at ends of the upper and lower flanges. The secondary beam 60' has a secondary beam connecting end 601 inserted into the second C-shaped sleeve 504. The secondary beam fixing steel plate 70 is provided on both sides with second wedge shaped protrusion 705 that can be tenon-and-mortise mated with the second wedge shaped recesses 505 of the second C-shaped sleeve 504.

Specifically, as shown in FIGS. 20A through 20B, the main beam-secondary beam connecting sleeve 50' includes a short box-shaped steel tube 501' and a second C-shaped sleeve 504 fixed on one side or both sides of the steel tube. The second C-shaped sleeve 504 is matched with the secondary beam fixing steel plate 70. The secondary beam fixing steel plate 70 is provided at both sides with wedge shaped protrusions 705 tenon-and-mortise mated with the wedge shaped recesses 505 of the second C-shaped sleeve 504.

As shown in FIG. 25C, a restraining member (e.g., a shear stud) 305 may be welded as illustrated with reference to FIGS. 18A through 18C, to fix the second box-shaped steel tube 501' of the main beam-secondary beam connecting sleeve 50'.

Next, the connection between the main beam and the secondary beam will be described with reference to FIGS. 21A through 24C. Depending on the position of the beam assembly in the structural system, the beam assembly may take on different forms. It should be noted that, although the cross-sections of main beam and the secondary beam are shown as H-shaped in the drawings, in practice, the cross-section of the main beam may also be box-shaped.

Figure 21A:
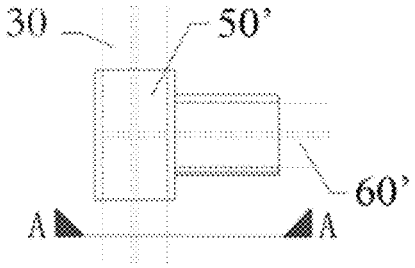
FIGS. 21A through 24C are indicative views illustrating four ways of connection between the main beam (a cantilever beam) and the secondary beam according to the second exemplary embodiment.
Figure 21B:
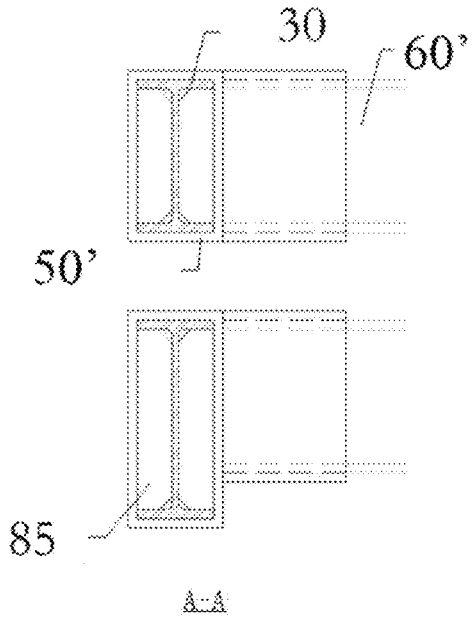
Figure 22A:
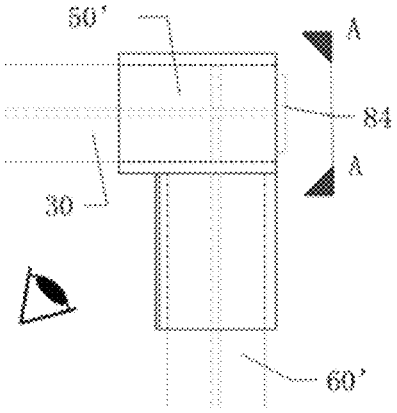
Figure 22B:
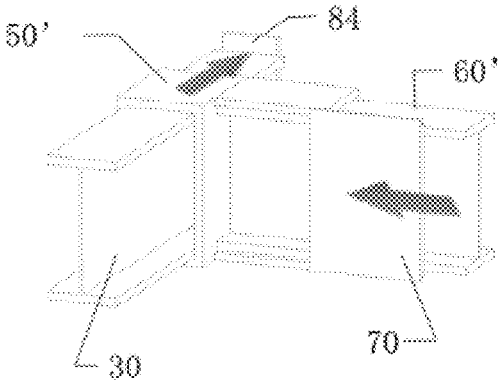
Figure 22C:
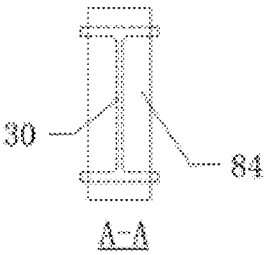
Figure 23A:
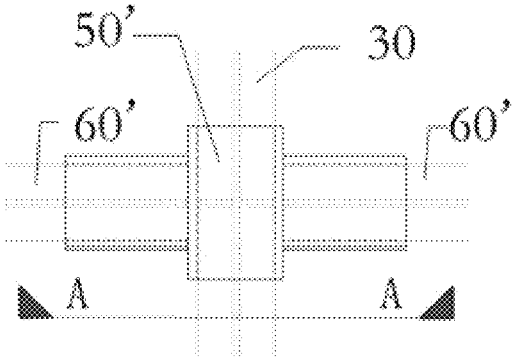
Figure 23B:
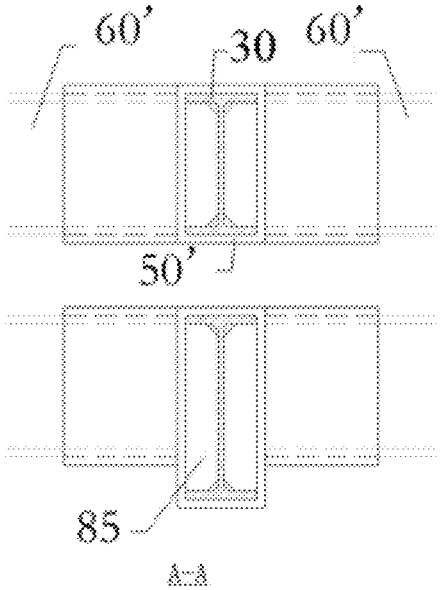
Figure 24A:
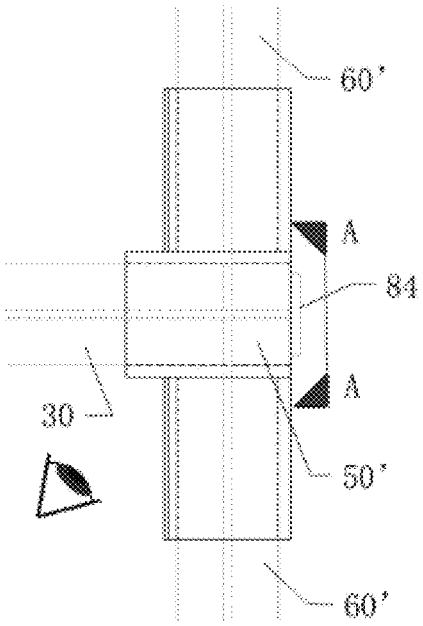
Figure 24B:
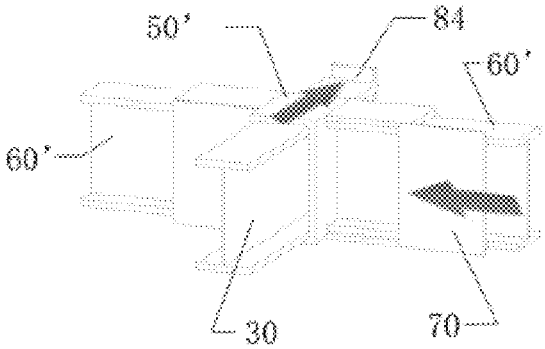
Figure 24C:
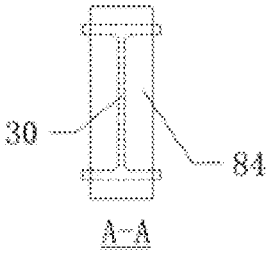
Figure 27A:
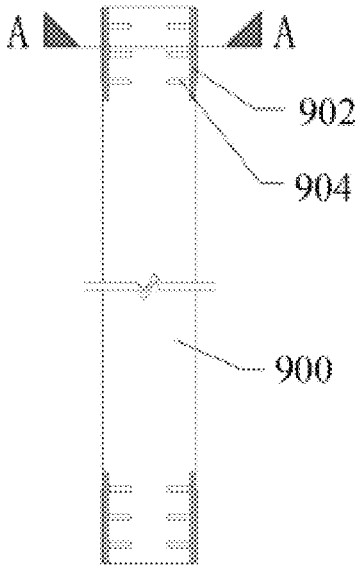
FIGS. 27A through 27B are indicative elevation views of a precast reinforced concrete column.
Figure 27B:
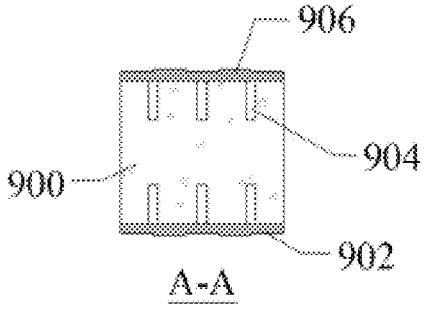
Figure 28A:
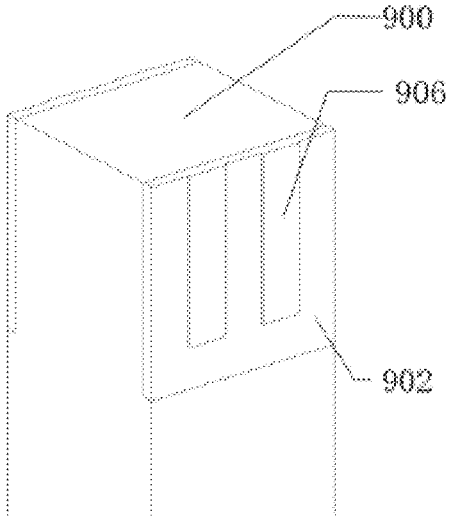
FIGS. 28A through 28B are enlarged indicative views of the end portion of the precast reinforced concrete column.
Figure 28B:
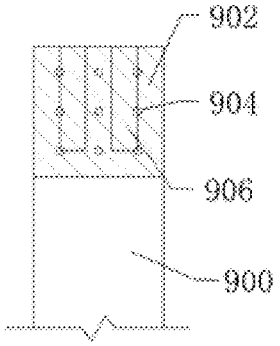
Figure 31:
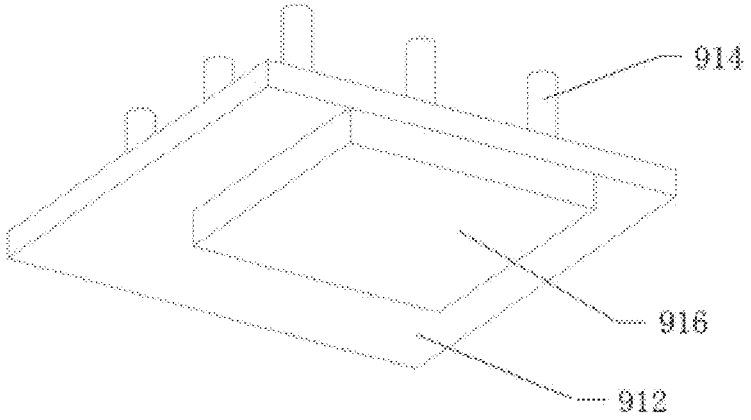
FIG. 31 is indicative view of a pre-embedded steel plate at the lower end of the precast reinforced concrete beam.
Figure 32A:
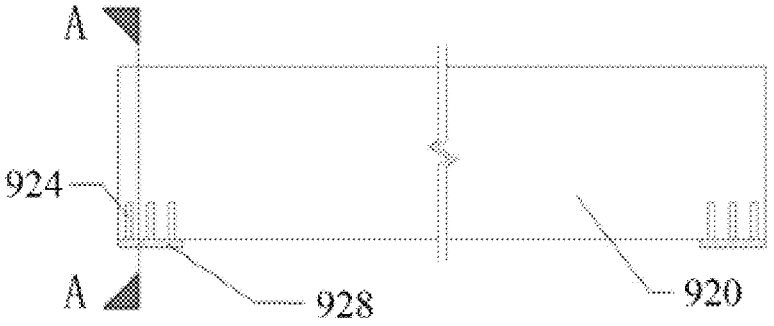
FIGS. 32A through 32B are indicative elevation views of a timber structural beam.
Figure 32B:
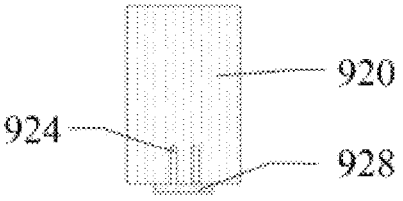
Figure 33A:
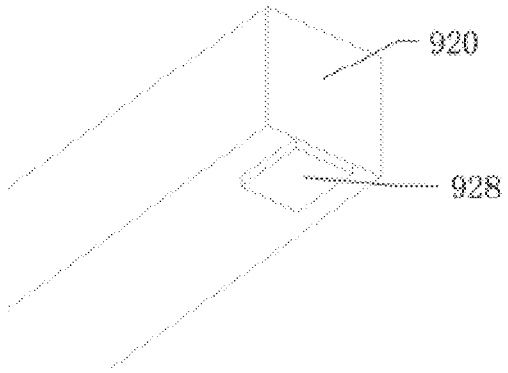
FIGS. 33A through 33C are enlarged indicative views of the end portion of the timber structural beam.
Figure 33B:
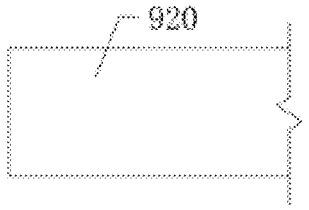
Figure 33C:
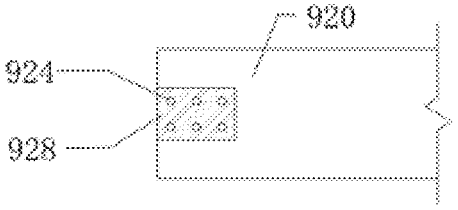

As shown in FIGS. 21A through 24C, assembling the main beam (a cantilevered beam) with the secondary beam includes the following four configurations: a main beam with one secondary beam to be connected at one side (as shown in FIGS. 21A through 21B corresponding to B1 in FIG. 1); a cantilevered beam with one secondary beam to be connected at one side (as shown in FIG. 22A through FIG. 22C corresponding to B1' in FIG. 1); a main beam with two secondary beam to be connected at both sides (as shown in FIGS. 23A through 23B corresponding to B2 in FIG. 1); and a cantilevered beam with two secondary beam to be connected at both sides (as shown in FIGS. 24A through 24C corresponding to B2' in FIG. 1). Since the methods of assembly for these four configurations are similar, the following description will be made with reference to the example in FIGS. 25A through 25C.

FIGS. 25A through 25C illustrate the assembly process for connecting the secondary beam and the main beam according to an embodiment of the present application.

In an alternative embodiment, the installation of the secondary beams 60' into the main beam-secondary beam connecting sleeve 50' includes: inserting the secondary beam connecting end 601 of the secondary beams 60' into the second C-shaped sleeve 504 which extends outward from and perpendicular to the second box-shaped steel tube 501' of the main beam-secondary beam connecting sleeve 50'; and inserting the secondary beam fixing steel plate 70 into the second C-shaped sleeve 504, such that a tenon-and-mortise joint is formed between second wedge shaped recesses 505 disposed at the ends of the upper and lower flanges of the second C-shaped sleeve 504 and second wedge shaped protrusions 705 provided on both sides of the secondary beam fixing steel plate, thereby restraining the secondary beam connecting end 601.

Specifically, before the main beam 30 is inserted into the first C-shaped sleeve 102, the second box-shaped steel tube 501' of the main beam-secondary beam connecting sleeve 50' is connected onto the main beam 30 and set into position, and subsequently the secondary beam 60' is hoisted in place and pushed from the side in a horizontal direction into the second C-shaped sleeve 504 which extends outward from the second box-shaped steel tube 501' on one side or both sides of the steel tube 501', and subsequently, the secondary beam fixing steel plate 70 with the wedge shaped protrusions 705 is horizontally inserted into the wedge shaped recess (or gap) 505 at the opening side of the second C-shaped sleeve.

In an alternative embodiment, the positioning of the main beam-secondary beam connecting sleeve may further include: connecting the second box-shaped steel tube 501' of the main beam-secondary beam connecting sleeve 50' onto the main beam 30; and welding a shear stud at center area of intersection between the upper flange of the main beam 30 and the main beam-secondary beam connecting sleeve 50' to restrain the position of the second box-shaped steel tube 501'.

Specifically, as shown in FIG. 25A through FIG. 25C, prior to the installation of the H-shaped main beam, the main beam-secondary beam connecting sleeves 50' may be connected onto the main beam 30 and be positioned; after that, the H-shaped secondary beam 60' hoisted in place is pushed laterally from the side into the second C-shaped sleeve provided on the main beam-secondary beam connecting sleeve 50'; and then the secondary beam fixing steel plate 70 with the wedge shaped protrusion 705 is horizontally inserted into the wedge shaped recess (or gap) 505 at the opening side of the second C-shaped sleeve 504, thereby forming a tenon-and-mortise joint.

FIGS. 26A through 26C illustrate another assembly process according to the second exemplary embodiment taking as an example the connection between the cantilevered beam and the secondary beam. The assembly for connecting the cantilevered beam end with the secondary beam is similar to that shown in FIGS. 25A through 25C, except that the ends of the cantilevered beams require in advance welding with steel end plate at a factory to fix the position of the main beam-secondary beam connecting sleeve. The details of such will not be repeated herein in consideration of conciseness of description.

In addition, when fabrication precision is insufficient or it is desired to further improve the reliability of the secondary beam transferring shear force to the main beam so as to improve energy dissipation ability of the structural system during an earthquake, it is advantageous to apply the steel adhesive onto the connection surfaces between the dovetail-shaped recesses inclined inwardly and the dovetail-shaped protrusions pertaining to the first main beam-secondary beam connecting sleeve implementation, and onto the connection surfaces between the secondary beam and the sleeve pertaining to the second main beam-secondary beam connecting sleeve implementation.

In an alternative embodiment, the assembling method further includes: after completing the above steps, inserting a connecting end of another column (for example, an upper column) into the beam-column connecting sleeve, from an upper side thereof, so as to repeat the assembling process.

To summarize the above embodiments, in one specific embodiment, the steps of assembling a prefabricated structural system on site may include sequentially: (i) installing columns at first floor; (ii) connecting a beam-column sleeve; (iii) connecting a main beam-secondary beam connecting sleeve onto a main beam; (iv) hoisting the main beam in place; (v) installing a main beam fixing plate; (vi) positioning the main beam-secondary beam connecting sleeve through installation of welding shear studs; (vii) installing a secondary beam; (viii) if the configuration includes a second main beam-secondary beam connecting sleeve, installing a secondary beam fixing steel plate; (i) installing columns at upper floors; and repeating (ii)-(viii).

According to the above embodiments, pre-fabricated columns and the main beam steel members are directly assembled together, by using the beam-column connecting sleeve similar to a tenon-and-mortise jointing structure; and pre-fabricated main beam and secondary beam steel members are assembled together, using a main beam-secondary beam connecting sleeve similar to the dovetail structure or a main beam-secondary beam connecting sleeve similar to a tenon-and-mortise jointing structure. With such a configuration, it is possible to not only realize a main steel structure with no-bolt and no-welding connections, but also improves the aseismic performance of the steel structural system. The fabrication procedures of the columns and steel beams, and the assembling procedure of the steel structural construction will be simplified.

In addition to the steel structure, the aforementioned prefabricated structural construction and assembly method thereof may be further extended to reinforced concrete structure. Hereafter, related configurations of the precast reinforced concrete column (i.e., the column), the beam and the beam-column connection sleeve will be described with reference to FIGS. 27A through 31. To more clearly illustrate the invention, the shear links and longitudinal reinforcement of the precast concrete columns and precast concrete beams are not shown in the Figures.

FIGS. 27A through 28B illustrate the configuration of a precast reinforced concrete column. As shown in FIGS. 27A through 28B, a reinforced concrete column 900 is prefabricated in factory. Both sides of both ends of the column 900 are embedded with a steel plate 902. A protruding rib 906 (also called a protruding groove 906) is provided on the surface of the steel plate 902 occluded with the groove 206 arranged on the beam-column connecting sleeve 10 reinforcing the connection so as to provide proper fixing of the components. The pre-embedded steel plate 902 is connected to the reinforced concrete column 900 by an anchoring reinforcement bar 904. The precast reinforced concrete column 900 and beam-column connecting sleeve 10 are assembled in the same way as those of the steel columns described above. In consideration of conciseness of the specification, the description is not repeated here.

FIGS. 29A through 31 show the configuration of a precast reinforced concrete beam. As shown in FIGS. 29A to 31, a reinforced concrete main beam 910 is prefabricated in a factory. Steel plates 911 and 912 are embedded on top and bottom surfaces at both ends of the beam, and a steel anti-slip steel plate 916 is installed on the bottom of pre-embedded steel plate 912 to connect the beam 910 with the beam-column connecting sleeve 10 during assembly so as to ensure proper fixing of the components. A pre-embedded narrow steel plate 918 is embedded in the center of the top of the reinforced concrete main beam 910, so as to fix the composite floor plate and the beam 910 with shear studs. The precast reinforced concrete beam 910 and the beam-column connecting sleeve 10 are installed in the same way as the aforementioned steel beams when they are assembled on site. In consideration of conciseness of the description, the description of such is not repeated herein.

In addition to steel structures and reinforced concrete structures, the aforementioned prefabricated structural system and the installing method thereof may be further extended to timber structures. The related arrangement of the timber structure beam and beam-column connecting sleeve will be described below with reference to FIGS. 32A through 33C.

A timber structural beam 920 is prefabricated at the factory. A steel anti-slip steel plate 928 is installed onto bottom surfaces of the both ends of the beam 920 by using flat steel shear stud or steel nails 924, so as to connect and fix the beam 920 with the beam-column connecting sleeve 10. The method of installing the prefabricated timber structure beam 920 and the beam-column connecting sleeve 10 on site is the same as that of the above aforementioned steel beam, and in consideration of conciseness of the description, the description of such will not be repeated herein.

Although the present application is mainly described in detail with the steel structural system as an example, those skilled in the art should understand that the conception of the present application may also be applied to reinforced concrete structures and timber structures. In addition, it should be understood that the materials made of steel as described above are only regarded as examples and not limitation, and for example, they may also be made of reinforced concrete or timber respectively.

In the various embodiments of the present application, the singular forms may include the plural meaning unless indicated otherwise to the contrary. For example, in embodiments, the number of the main beam may be one or two, the number of the column may be one or two (a upper column and a lower column) and the number of the first and the second C-shaped sleeve may be one or two depending on reality situation; however, this is merely exemplary and not for limitation. Throughout this document, technical terms are not limited to the literally defined meanings, but include different meanings for implementing the same or similar functions without departing from the scope of the application as defined in the claims.

Additionally, it should be noted that some of the steps described herein do not necessarily occur in the written order, unless explicitly indicated. For example, in some alternative embodiments, the functions represented in the blocks may be performed not under the order indicated in the figures.

The above description is only the preferred embodiments of the present application and the description of the technical principles of the present application. Those skilled in the art should understand that the scope of the application involved in the present application is not limited to the technical solution formed by a specific combination of the above technical features. The application should also cover other technical solutions formed by any combination of the technical features described above or their equate features. The application should also cover, for example, the technical solutions formed by replacing the above features with technical features having similar functions to those disclosed in the present application.

What is claimed is:

1. A prefabricated structural system comprising a plurality of steel structure joints, characterized in that, the steel structure joints further comprise:

a beam-column connecting sleeve, comprising a first box-shaped steel tube and first C-shaped sleeves extending from and perpendicular to outer surfaces of the first box-shaped steel tube, wherein the first C-shaped sleeve is provided with first wedge shaped recesses at ends of upper and lower flanges thereof;

a column, having a column connecting end inserted into the first box-shaped steel tube;

a main beam, having a main beam connecting end inserted into the first C-shaped sleeve; and a main beam fixing steel plate, provided with first wedge shaped protrusions that are tenon-mortise-jointed with the first wedge shaped recesses of the first C-shaped sleeve at both sides.

2. The prefabricated structural system of claim 1, wherein the steel structure joints further comprise:

a main beam-secondary beam connecting sleeve, comprising a second box-shaped steel tube and steel connecting plates extending from and perpendicular to the sides of the second box-shaped steel tube, wherein the steel connecting plate is provided with dovetail-shaped recesses inclined inwardly at the far end from the second box-shaped steel tube; and a secondary beam provided, at both ends thereof, with dovetail-shaped protrusions that are tenon-mortise-jointed with the dovetail-shaped recesses of the steel connecting plate.

3. The prefabricated structural system of claim 1, wherein the steel structure joints further comprise:

a main beam-secondary beam connecting sleeve, comprising a second box-shaped steel tube and a second C-shaped sleeve extending from and perpendicular to the outer surfaces of the second box-shaped steel tube, wherein the second C-shaped sleeve is provided with second wedge shaped recesses at ends of the upper and lower flanges;

secondary beams, having a secondary beam connecting end inserted into the second C-shaped sleeve;

a secondary beam fixing steel plate provided, at both sides thereof, with a second wedge shaped protrusion that is tenon-mortise-jointed with the second wedge shaped recess of the second C-shaped sleeve.

4. The prefabricated structural system of claim 2 or 3, wherein a restraining member is installed on an upper surface of the main beam, the restraining member being positioned at an intersection between the upper flange of the main beam and the both sides of the main beam-secondary beam connecting sleeve so as to fix the main beam-secondary beam connecting sleeve.

5. The prefabricated structural system of claim 4, wherein the restraining member is a shear stud welded on the upper surface of the main beam.

6. The prefabricated structural system of claim 1, wherein the first C-shaped sleeve is provided with a restraining groove on a bottom surface thereof, and a restraining protrusion matched with the restraining groove is provided on a bottom of the lower flange of the main beam connecting end.

7. The prefabricated structural system of claim 1, wherein protruding teeth are provided at an inner surface of the first box-shaped steel tube, wherein grooves matched with the protruding teeth are provided at an outer surface of the column connecting end, and the grooves extend to the end surface of the column connecting end.

8. The prefabricated structural system of claim 1, wherein an inner horizontal stiffener is provided within the first box-shaped steel tube, a surface of the inner horizontal stiffener being in contact with an end surface of the column connecting end.

9. The prefabricated structural system of claim 1, wherein a cross section of the column is box-shaped, H-shaped or circular.

10. The prefabricated structural system of claim 1, wherein a cross section of the main beam is H-shaped or box-shaped.

11. The prefabricated structural system of claim 1, further comprising a steel adhesive applied between connecting surfaces of at least one of the connecting ends.

12. The prefabricated structural system of claim 1, wherein the column and the main beam are precast reinforced concrete member having a column connecting end and a main beam connecting end inserted into the beam-column connecting sleeve respectively.

13. The prefabricated structural system of claim 1, wherein the column and the main beam are prefabricated timber members having a column connecting end and a main beam connecting end inserted into the beam-column connecting sleeve.

14. A method of assembling a prefabricated structural system, comprising:

fixing a column connecting end;

connecting, from an upper side of the column, a first box-shaped steel tube of a beam-column connecting sleeve onto a column connecting end of the column;

inserting a main beam connecting end of a main beam into a first C-shaped sleeve of the beam-column connecting sleeve extending from and perpendicular to an outer side of the first box-shaped steel tube; and inserting a main beam fixing steel plate into the C-shaped sleeve such that a tenon-mortise joint is formed between first wedge shaped recesses provided at ends of upper and lower flanges of the first C-shaped sleeve and first wedge shaped protrusions provided at both sides of the main beam fixing steel plate, thereby restraining the main beam connecting end.

15. The method of claim 14, further comprising:

connecting a main beam-secondary beam connecting sleeve onto the main beam before inserting the main beam connecting end into the first C-shaped sleeve, and fixing the main beam-secondary beam connecting sleeve after inserting a main beam fixing steel plate into the first C-shaped sleeve; and installing a secondary beam into the main beam-secondary beam connecting sleeve.

16. The method of claim 15, wherein installing the secondary beam into the main beam-secondary beam connecting sleeve comprises:

pushing the secondary beam from an upper side, into a steel connecting plate extending perpendicularly from the second box-shaped steel tube of the main beam-secondary beam connecting sleeve, such that a tenon-mortise jointing is formed between dovetail-shaped recesses inclined inwardly at the end of the steel connecting plate and dovetail-shaped protrusions provided at the end of the secondary beam.

17. The method of claim 15, wherein installing the secondary beam into the main beam-secondary beam connecting sleeve comprises:

inserting a secondary beam connecting end of the secondary beam into a second C-shaped sleeve extending from and perpendicular to the second box-shaped steel tube of the main beam-secondary beam connecting sleeve; and inserting a secondary beam fixing steel plate into the second C-shaped sleeve such that a tenon-mortise jointing is formed between second wedge shaped recesses provided at ends of the upper and lower flanges of the second C-shaped sleeve and second wedge shaped protrusions at both sides of the secondary beam fixing steel plate, thereby restraining the secondary beam connecting end.

18. The method of claim 16 or 17, wherein fixing the main beam-secondary beam connecting sleeve comprises:

welding shear studs on a upper surface of the main beam, such that the shear studs are positioned at an intersection of an upper flange of the main beam and both sides of the main beam-secondary beam connecting sleeve so as to fix the main beam-secondary beam connecting sleeve.

19. The method of claim 14, wherein inserting the main beam connecting end into the first C-shaped sleeve comprises:

inserting the main beam connecting end of the main beam into the first C-shaped sleeve of the beam-column connecting sleeve laterally from the side of the main beam, such that a restraining protrusion provided at bottom of the lower flange of the main beam connecting end fits into a restraining groove provided at bottom of the first C-shaped sleeve.

20. The method of claim 14, wherein connecting the first box-shaped steel tube onto the column connecting end comprises:

connecting, from an upper side of the column, the first box-shaped steel tube of the beam-column connecting sleeve onto the column connecting end of the column, such that protruding teeth provided on an inner surface of the first box-shaped steel tube are engaged with grooves provided on an outer surface of the column connecting end.

21. The method of claim 14, wherein connecting the first box-shaped steel tube onto the column connecting end comprises:

connecting, from an upper side of the column, the first box-shaped steel tube of the beam-column connecting sleeve onto the column connecting end of the column, such that an end surface of the column connecting end contacts with a surface of the inner horizontal stiffener within the first box-shaped steel tube.

22. The method of claim 14, further comprising:

applying steel adhesive between connecting faces of at least one of the connecting ends.

23. The method of claim 14, further comprising:

inserting, from an upper side of the beam-column connecting sleeve, a connecting end of another column into the beam-column connecting sleeve so as to repeat the installation process.

24. The method of claim 14, further comprising:

prefabricating reinforced concrete members to form the column and the main beam having a column connecting end and a main beam connecting end inserted into the beam-column connecting sleeve.

25. The method of claim 14, further comprising:

prefabricating timber members to form the column and the main beam, having a column connecting end and a main beam connecting end inserted into the beam-column connecting sleeve, respectively.

* * * * *